US008286958B2

(12) United States Patent
Suzuki et al.

(10) Patent No.: US 8,286,958 B2
(45) Date of Patent: Oct. 16, 2012

(54) SPINE FORMATION DEVICE, POST-PROCESSING APPARATUS, SPINE FORMATION SYSTEM, AND SPINE FORMATION METHOD

(75) Inventors: Nobuyoshi Suzuki, Tokyo (JP); Shinji Asami, Machida (JP); Naohiro Kikkawa, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 102 days.

(21) Appl. No.: 12/801,391

(22) Filed: Jun. 7, 2010

(65) Prior Publication Data

US 2010/0310340 A1 Dec. 9, 2010

(30) Foreign Application Priority Data

Jun. 9, 2009 (JP) ..... 2009-138515
Jan. 22, 2010 (JP) ..... 2010-012267

(51) Int. Cl.
*B31F 1/08* (2006.01)

(52) U.S. Cl. ..... 270/45; 270/32; 270/37; 270/58.07

(58) Field of Classification Search ..... 270/32, 270/37, 45, 58.07, 58.08, 58.11; 412/22, 412/23
See application file for complete search history.

(56) References Cited

U.S. PATENT DOCUMENTS 6,000,894 A * 12/1999 Suzuki et al. ..... 412/11
6,264,191 B1 7/2001 Suzuki
6,394,448 B2 5/2002 Suzuki
6,921,069 B2 7/2005 Suzuki
7,090,213 B2 8/2006 Suzuki
7,137,944 B2 11/2006 Suzuki
7,147,598 B2 * 12/2006 Fujimoto et al. ..... 493/405
7,326,167 B2 2/2008 Suzuki
7,416,177 B2 8/2008 Suzuki
7,431,273 B2 * 10/2008 Kamiya et al. ..... 270/37
7,487,964 B2 2/2009 Suzuki
2002/0135119 A1 9/2002 Suzuki
2003/0151187 A1 8/2003 Suzuki (Continued)

FOREIGN PATENT DOCUMENTS

JP 2001-260564 9/2001

(Continued)

OTHER PUBLICATIONS

Japanese Office Action dated Sep. 2, 2010.

*Primary Examiner* — Leslie A Nicholson, III
(74) *Attorney, Agent, or Firm* — Harness, Dickey & Pierce, P.L.C.

(57) ABSTRACT

An spine formation device includes a sheet conveyer that conveys the bundle of folded sheets in a sheet conveyance direction with a folded portion of the bundle forming front end portion thereof, first and second sandwiching units disposed downstream from the sheet conveyer, a contact member disposed downstream from the second sandwiching unit, against which the folded portion of a bundle of folded sheets is pressed, and a controller. The controller stops the sheet conveyer after the bundle is transported a predetermined distance from a contact position between the contact member and the folded portion of the bundle, causing the bundle to bulge, and causes the first and second sandwiching units to squeeze the bulging of the bundle of folded sheets in a thickness direction sequentially with the folded portion of the bundle pressed against the contact member to form a spine of the bundle.

13 Claims, 17 Drawing Sheets

U.S. PATENT DOCUMENTS

| | | | |
|---|---|---|---|
| 2004/0254054 | A1 | 12/2004 | Suzuki |
| 2005/0179190 | A1 | 8/2005 | Kamiya et al. |
| 2005/0191154 | A1 | 9/2005 | Fujimoto et al. |
| 2005/0206071 | A1 | 9/2005 | Suzuki |
| 2006/0055100 | A1 | 3/2006 | Suzuki |
| 2006/0180999 | A1 | 8/2006 | Suzuki |
| 2008/0067730 | A1 | 3/2008 | Suzuki |
| 2008/0211162 | A1 | 9/2008 | Suzuki |
| 2008/0284092 | A1 | 11/2008 | Suzuki |
| 2009/0258774 | A1 | 10/2009 | Suzuki |
| 2010/0239393 | A1 | 9/2010 | Suzuki et al. |
| 2010/0258994 | A1 | 10/2010 | Kikkawa et al. |
| 2010/0303585 | A1 | 12/2010 | Asami et al. |

FOREIGN PATENT DOCUMENTS

| | | |
|---|---|---|
| JP | 2007-237562 | 9/2007 |

* cited by examiner

SPINE FORMATION DEVICE, POST-PROCESSING APPARATUS, SPINE FORMATION SYSTEM, AND SPINE FORMATION METHOD

CROSS-REFERENCE TO RELATED APPLICATIONS

This patent specification is based on and claims priority from Japanese Patent Application Nos. 2009-138515, filed on Jun. 9, 2009, and 2010-012267, filed on Jan. 22, 2010, in the Japan Patent Office, the contents of which are hereby incorporated by reference herein in their entirety.

BACKGROUND OF THE INVENTION

1. Field of the Invention

The present invention generally relates to a spine formation device to form a spine of a bundle of folded sheets, a post-processing apparatus including the spine formation device, and a spine formation system including the spine formation device and an image forming apparatus, and a method of forming a spine of a booklet.

2. Discussion of the Background Art

Post-processing apparatuses to perform post processing of recording media, such as aligning, sorting, stapling, punching, and folding of sheets, are widely used and are often disposed downstream from an image forming apparatus to perform post-processing of the sheets output from the image forming apparatus. At present, post-processing apparatuses generally perform saddle-stitching along a centerline of sheets in addition to conventional edge-stitching along an edge portion of sheets.

However, when a bundle of sheets (hereinafter "booklet") is saddle-stitched or saddle-stapled and then folded in two, its folded portion, that is, a portion around its spine, tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

By contrast, when the spine of the booklet is flattened, bulging of the booklet can be reduced, and accordingly multiple booklets can be piled together. This flattening is important for ease of storage and transport because it is difficult to stack booklets together if their spines bulge, making it difficult to store or carry them. With this reformation, a relatively large number of booklets can be piled together.

It is to be noted that the term "spine" used herein means not only the stitched side of the booklet but also portions of the front cover and the back cover continuous with the spine.

To improve the quality of the finished product, several approaches, described below, for shaping the folded portion of a bundle of saddle-stitched sheets have been proposed.

For example, in JP-2001-260564-A, the spine of the booklet is flattened using a pressing member configured to sandwich an end portion of the booklet adjacent to the spine and a spine-forming roller configured to roll in a longitudinal direction of the spine while contacting the spine of the booklet. The spine-forming roller moves at least once over the entire length of the spine of the booklet being fixed by the pressing member while applying to the spine a pressure sufficient to flatten the spine.

Although this approach can flatten the spine of the booklet to a certain extent, it is possible that the sheets might wrinkle and be torn around the spine or folded portion because the pressure roller applies localized pressure to the spine continuously. Further, it takes longer to flatten the spine because the pressure roller moves over the entire length of the spine of the booklet. Moreover, because only the bulging portion is pressed with the spine-forming roller in this approach, the booklet can wrinkle in a direction perpendicular to the longitudinal direction in which the spine extends, degrading its appearance. In addition, with larger sheet sizes, productivity decreases because it takes longer for the spine-forming roller to move over the entire length of the spine of the booklet.

Therefore, for example, in JP-2007-237562-A, the spine of the booklet is flattened using a spine pressing member (e.g., a spine pressing plate) pressed against the spine of the booklet, a sandwiching member that sandwiches the booklet from the front side and the back side, and a pressure member disposed downstream from the sandwiching member in a direction in which the bundle of folded sheets is transported. After the spine pressing plate is pressed against the spine of the booklet, the pressure member squeezes the spine from the side, that is, in the direction of the thickness of the booklet to reduce bulging of the spine.

Although this approach can reduce, in spine formation, wrinkles of and damage to the booklet caused by the first method described above, the processing time can be still relatively long because the sandwiching member and the pressure member are operated sequentially after the booklet is pressed against the spine pressing plate. In addition, the device is bulky because a motor is necessary to move the spine pressing plate in a reverse direction of the sheet conveyance direction. Further, a relatively large driving force is necessary because the pressing member squeezes the booklet in a relatively small area between the spine pressing plate and the sandwiching member while the folded portion of the booklet is pressed against the spine pressing plate, increasing the power consumption, which is not desirable.

In view of the foregoing, the inventors of the present invention recognize that there is a need to reduce bulging of booklets while reducing the processing time as well as damage to the booklet, which known approaches fail to do.

SUMMARY OF THE INVENTION

In view of the foregoing, a purpose of the present invention is to flatten the spine of booklets with the bulging of the booklet reduced in a shorter time period while preventing the booklet from wrinkling and being torn.

One illustrative embodiment of the present invention provides a spine formation device to flatten a spine of a bundle of folded sheets that includes a sheet conveyer, a first sandwiching unit disposed downstream from the sheet conveyer in a sheet conveyance direction in which the bundle of folded sheets is transported, a second sandwiching unit disposed downstream from the first sandwiching unit, a contact member disposed downstream from the second sandwiching unit, and a controller operatively connected to the sheet conveyer and the first and second sandwiching units. The contact member includes a flat contact surface against which a folded portion of the bundle of folded sheets is pressed, disposed perpendicular to the sheet conveyance direction. The sheet conveyer conveys the bundle of folded sheets with the folded portion of the bundle of folded sheets forming a front end portion thereof in the sheet conveyance direction.

The controller stops the sheet conveyer after the bundle of folded sheets is transported a predetermined distance downstream in the sheet conveyance direction from a contact position between the contact member and the folded portion of the bundle of folded sheets and causes the first and second sandwiching units to squeeze the bundle of folded sheets in a direction of thickness of the bundle of folded sheets with the folded potion pressed against the contact member. Thus, the first sandwiching unit localizes a bulging of the bundle of folded sheets created between the sheet conveyer and the contact member to a downstream side in the sheet conveyance direction, and the second sandwiching unit forms a spine of the bundle of folded sheets by squeezing a bulging of the bundle of folded sheets created between the first sandwiching unit and the contact member.

In another illustrative embodiment of the present invention, a post-processing apparatus includes a saddle-stapler to staple a bundle of sheets together along a centerline of the bundle, a folding unit to fold the bundle of sheets along the centerline of the bundle, and the spine formation device described above.

Yet in another illustrative embodiment, a spine formation system includes an image forming apparatus, a post-processing apparatus to perform post processing of sheets transported from the image forming apparatus, and the spine formation device described above.

Yet another illustrative embodiment provides a spine formation method used in the above-described spine formation device. The spine formation method includes transporting a bundle of folded sheets with the folded portion of the bundle of folded sheets forming a front end portion thereof in the sheet conveyance direction, causing the bundle of folded sheets to bulge by stopping the sheet conveyer after the bundle of folded sheets is transported in the sheet conveyance direction a predetermined distance from a contact position between the contact member and the folded portion of the bundle, localizing a bulging of the bundle of folded sheets to a downstream side in the sheet conveyance direction by squeezing the bundle of folded sheets in a direction of thickness of the bundle of folded sheets with the first sandwiching unit, and forming a spine of the bundle of folded sheets by squeezing the bulging of the bundle of folded sheets created between the first sandwiching unit and the contact member in the direction of thickness of the bundle of folded sheets with the second sandwiching unit while the folded portion is pressed against the contact member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
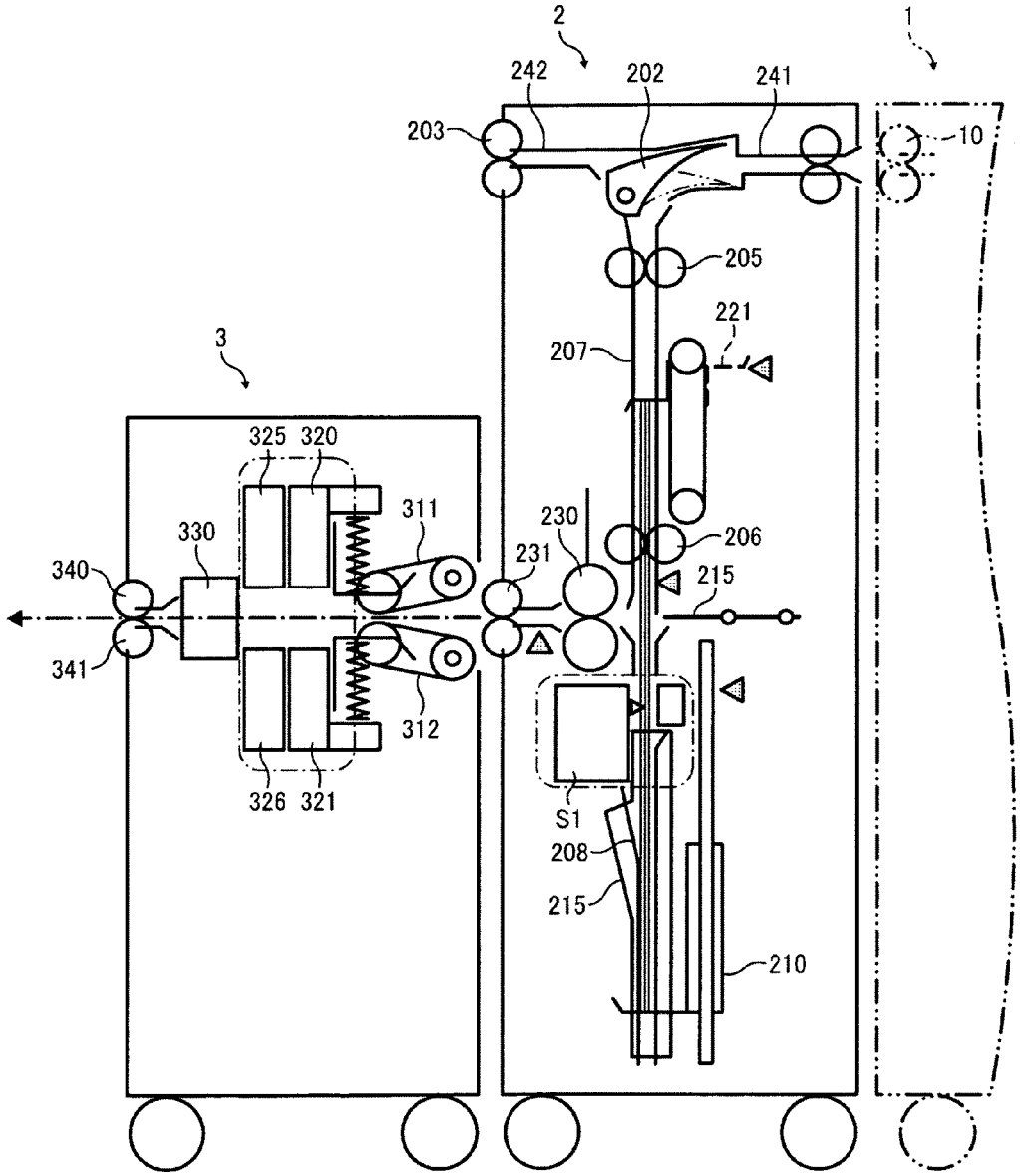
FIG. 1 illustrates a spine formation system including an image forming apparatus, a post-processing apparatus and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a spine formation system according to an illustrative embodiment of the present invention is described.

It is to be noted that, in the description below, a pair of transport belts 311 and 312 of a transport unit 31 serve as a sheet conveyer, a contact plate 330 serve as a contact member, a pair of auxiliary sandwiching plates 320 and 321 serve as a first sandwiching unit, a pair of sandwiching plates 325 and 326 serve as a second sandwiching unit, a central processing unit (CPU) 111 serves as a controller, and a sheet detector SN1 serves as a detector.

FIG. 1 illustrates a spine formation system including an image forming apparatus 1, a post-processing apparatus 2, and a spine formation device 3 according to an illustrative embodiment of the present invention.

In FIG. 1, the post-processing apparatus 2 that perform saddle-stitching and center folding is connected to a downstream side of the image forming apparatus 1, and the spine formation device 3 is connected to a downstream side of the post-processing apparatus 2 in a direction in which a bundle of sheets is transported (hereinafter "sheet conveyance direction"). In this system, the post-processing apparatus 2 performs saddle-stitching or saddle-stapling, that is, stitches or staples, along its centerline, a bundle of sheets discharged thereto by a pair of discharge rollers 10 from the image forming apparatus 1 and then folds the bundle of sheets along the centerline, after which a pair of discharge rollers 231 transports the bundle of folded sheets (hereinafter also "booklet") to the spine formation device 3. Then, the spine formation device 3 flattens the folded portion of the booklet and discharges it outside the spine formation device 3. The image forming apparatus 1 may be a copier, a printer, a facsimile machine, or a multifunction machine including at least two of those functions that forms images on sheets of recording media based on image data input by users or read by an image reading unit. The spine formation device 3 includes the transport belts 311 and 312, the auxiliary sandwiching plates 320 and 321, the sandwiching plates 325 and 326, the contact plate 330, and discharge rollers 340 and 341 disposed in that order in the sheet conveyance direction.

Figure 2:
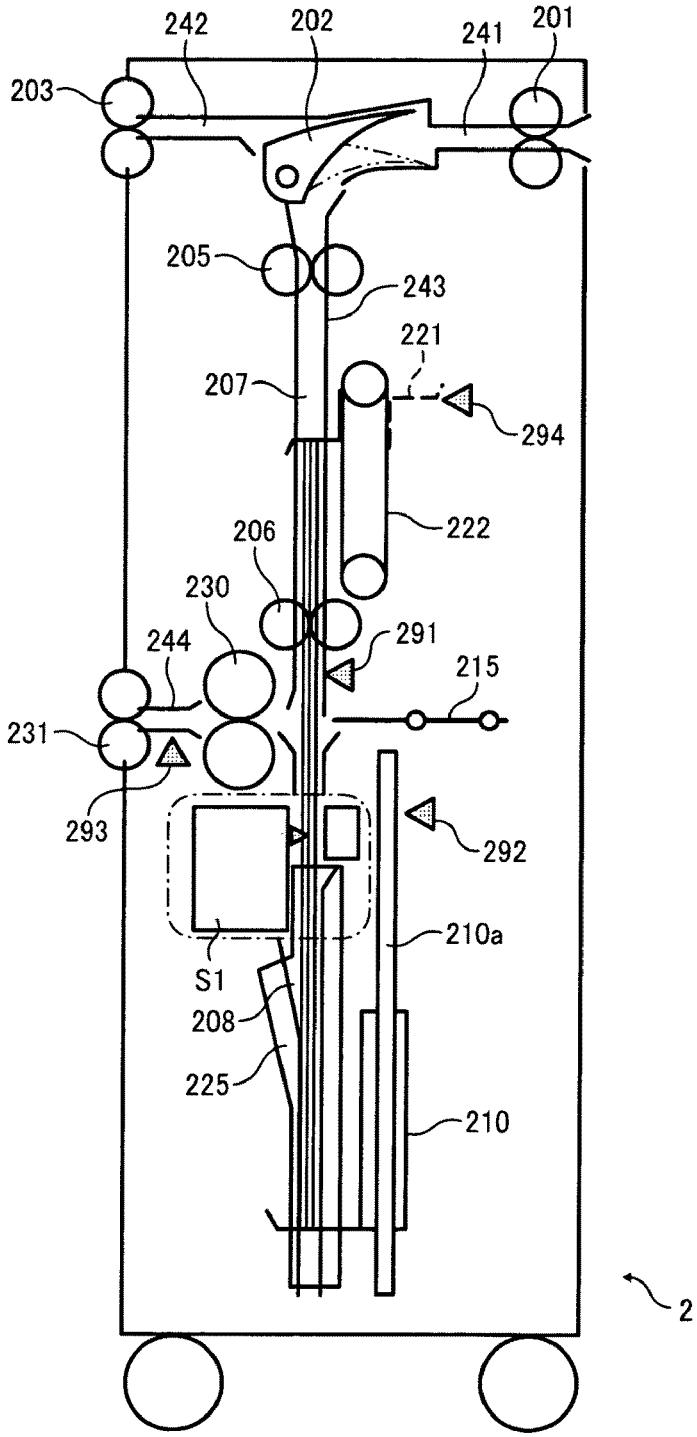
FIG. 2 is a front view illustrating a configuration of the post-processing apparatus shown in FIG. 1.

Referring to FIGS. 1 and 2, a configuration of the post-processing apparatus 2 is described below.

FIG. 2 illustrates a configuration of the post-processing apparatus 2.

Referring to FIG. 2, an entrance path 241, a sheet path 242, and a center-folding path 243 are formed in the post-processing apparatus 2. A pair of entrance rollers 201 provided extreme upstream in the entrance path 241 in the sheet conveyance direction receives a bundle of aligned sheets transported by the discharge rollers 10 of the image forming apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in FIG. 2 and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in FIGS. 1 and 2 from the separation pawl 202, and the bundle of sheets is transported along the center-folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 2. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 2, thus aligning the bundle of sheets. Additionally, the trailing-edge alignment pawl 221 moves away from the upper sheet guide 207 to a position indicated by broken lines shown in FIG. 2 when the bundle of sheets enters the center-folding path 243 and ascends to a folding position from the alignment position. In FIG. 2, reference numeral 294 represents a pawl home position (HP) detector that detects the trailing-edge alignment pawl 221 at a home position indicated by the broken lines shown in FIG. 2. The trailing-edge alignment pawl 221 is controlled with reference to the home position.

A saddle stapler S1, a pair of jogger fences 225, and the movable fence 210 are provided along the lower sheet guide 208 in that order from the top in FIG. 2. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the post-processing apparatus 2 in FIG. 2. A movable range of the movable fence 210 that contacts the leading edge of the bundle of sheets is set so that strokes of the movable fence 210 can align sheets of any size processed by the post-processing apparatus 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the center-folding path 243 in FIG. 2. The folding plate 215 can move reciprocally back and forth horizontally in FIG. 2 in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 2 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizing the passage of the bundle of folded sheets.

Saddle-stapling and center-holding performed by the post-processing apparatus 2 shown in FIG. 2 are described briefly below with reference to FIGS. 3 through 7.

When a user selects saddle-stapling and center-folding via an operation panel 113 (shown in FIG. 20) of the image forming apparatus 1 shown in FIG. 1, the separation pawl 202 pivots counterclockwise in FIG. 2, thereby guiding the bundle of sheets to be stapled and folded to the center-folding path 243. The separation pawl 201 is driven by a solenoid, not shown. Alternatively, the separation pawl 201 may be driven by a motor.

Figure 3:
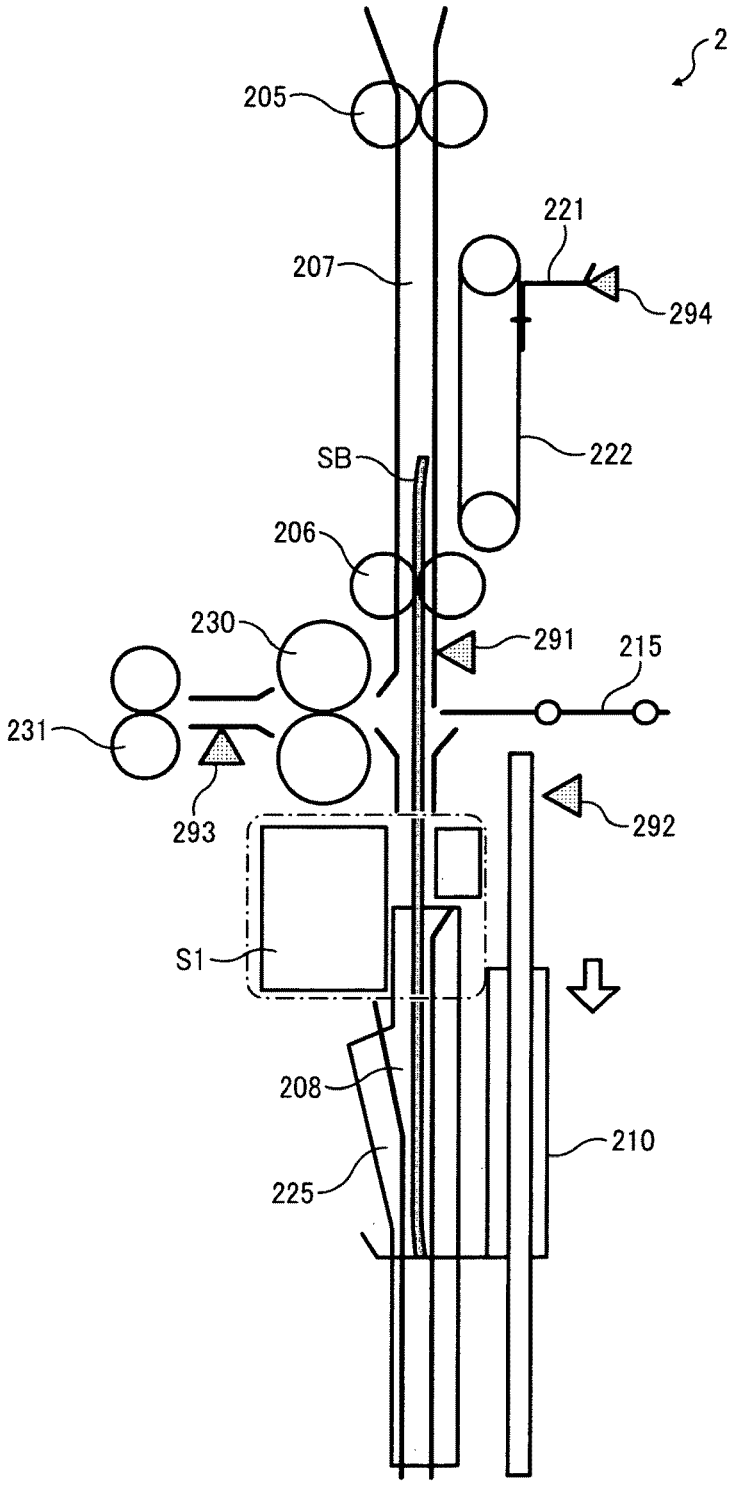
FIG. 3 illustrates the post-processing apparatus in which a bundle of sheets is transported.

A bundle of sheets SB transported to the center-folding path 243 is transported by the upper transport rollers 205 downward in the center-folding path 243 in FIG. 3. After the sheet detector 291 detects the passage of the bundle of sheet SB, the lower transport rollers 206 transport the bundle of sheets SB until the leading edge of the bundle of sheets SB contacts the movable fence 210 as shown in FIG. 3. At that time, the movable fence 210 is at a standby position that is varied in the vertical direction shown in FIG. 3 according to sheet size data, that is, sheet size data in the sheet conveyance direction, transmitted from the image forming apparatus 1 shown in FIG. 1. Simultaneously, the lower transport rollers 206 sandwich the bundle of sheets SB therebetween, and the trailing-edge alignment pawl 221 is at the home position.

Figure 4:
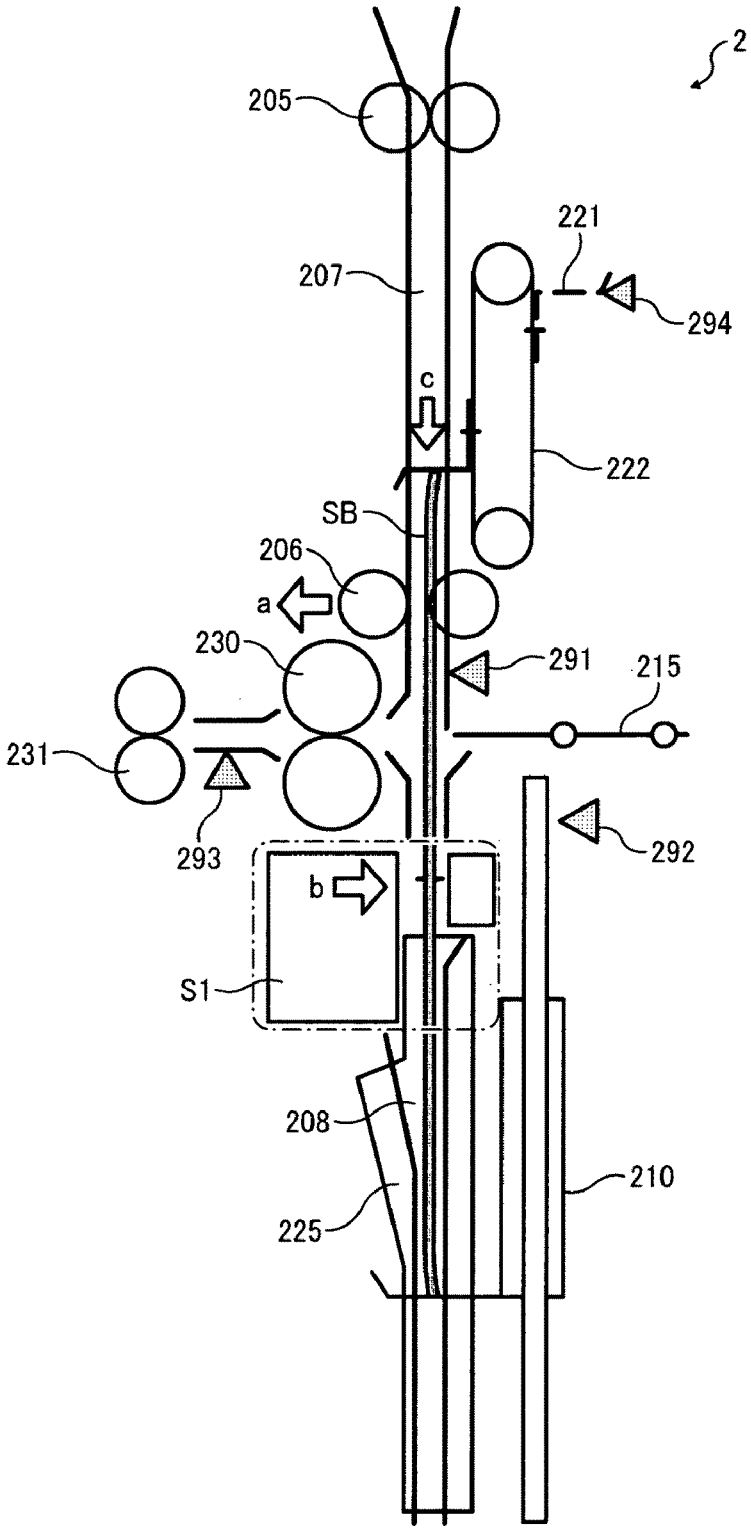
FIG. 4 illustrates the post-processing apparatus in which the bundle of sheets is stapled along the centerline.

When the pair of lower transport rollers 206 is moved away from each other as indicated by arrow a shown in FIG. 4, releasing the trailing edge of the bundle of sheets SB whose leading edge is in contact with the movable fence 210, the trailing-edge alignment pawl 221 is driven to push the trailing edge of the bundle of sheets SB, thus aligning the bundle of sheets SB in the sheet conveyance direction as indicated by arrow c shown in FIG. 4.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the sheet size, the number of sheets, and the thickness of the bundle.

It is to be noted that, when the bundle of sheets SB is relatively thick, the bundle of sheets SB occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the number of sheets increases, it takes longer to stack multiple sheets one on another upstream from the post-processing apparatus 2, and accordingly it takes longer before the post-processing apparatus 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler S1 is driven in a direction indicated by arrow b shown in FIG. 4, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 111 of a control circuit 110 serving as a controller, shown in FIG. 20, of the post-processing apparatus 2.

The control circuit 110 of the post-processing apparatus 2 is described below with reference to FIG. 20, which is a schematic block diagram of the control circuit 110.

The control circuit 110 incorporates a micro computer including the CPU 111 and an input/output (I/O) interface 112. In the control circuit 110, the CPU 111 performs various types of control according to signals received via the I/O interface 112 from respective switches in an operation panel 113 of the image forming apparatus 1, a sensor group 130 including various sensors and detectors. The CPU 111 reads out program codes stored in a read only memory (ROM), not shown, and performs various types of control based on the programs defined by the program codes using a random access memory (RAM), not shown, as a work area and data buffer.

The control circuit 110 includes drivers 111A, motor drivers 111B, 111C, and 112A, and a pulse module width (PWM) generator 112C, and communicates with stepping motors 112B, solenoids 113A, direct current (DC) motors 113B, stepping motors 113C, and sensor groups 113D.

Figure 5:
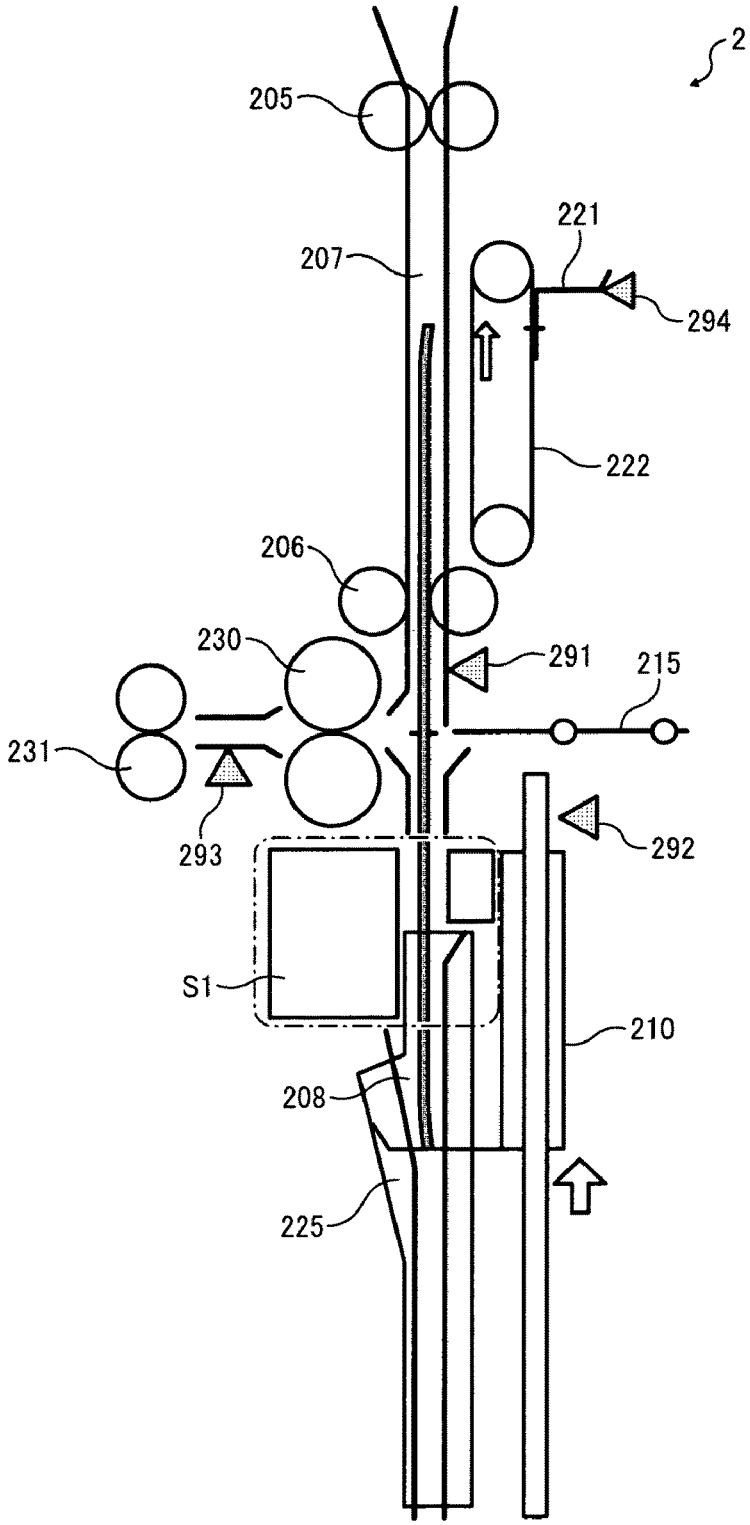
FIG. 5 illustrates the post-processing apparatus in which the bundle of sheets is set at a center-folding position.

After stapled along the centerline in the state shown in FIG. 4, the bundle of sheets SB is lifted to a position where the saddle-stapling position thereof faces the folding plate 215 as the movable fence 210 moves upward as shown in FIG. 5 while the pair of lower transport rollers 206 does not press against the bundle of sheets SB. This position is adjusted with reference to the position detected by the fence HP detector 292.

Figure 6:
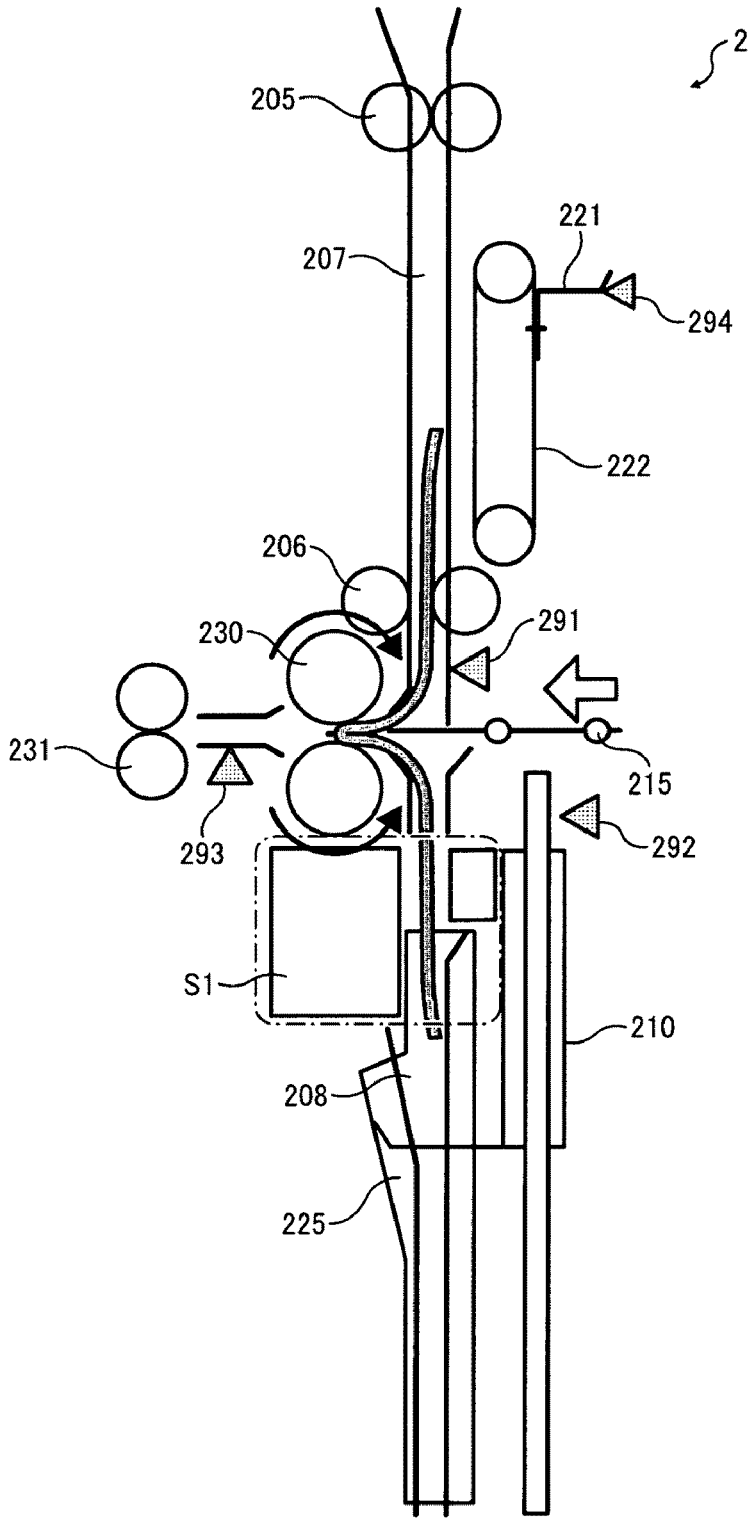
FIG. 6 illustrates the post-processing apparatus in which the bundle of sheets is being folded in two.
Figure 7:
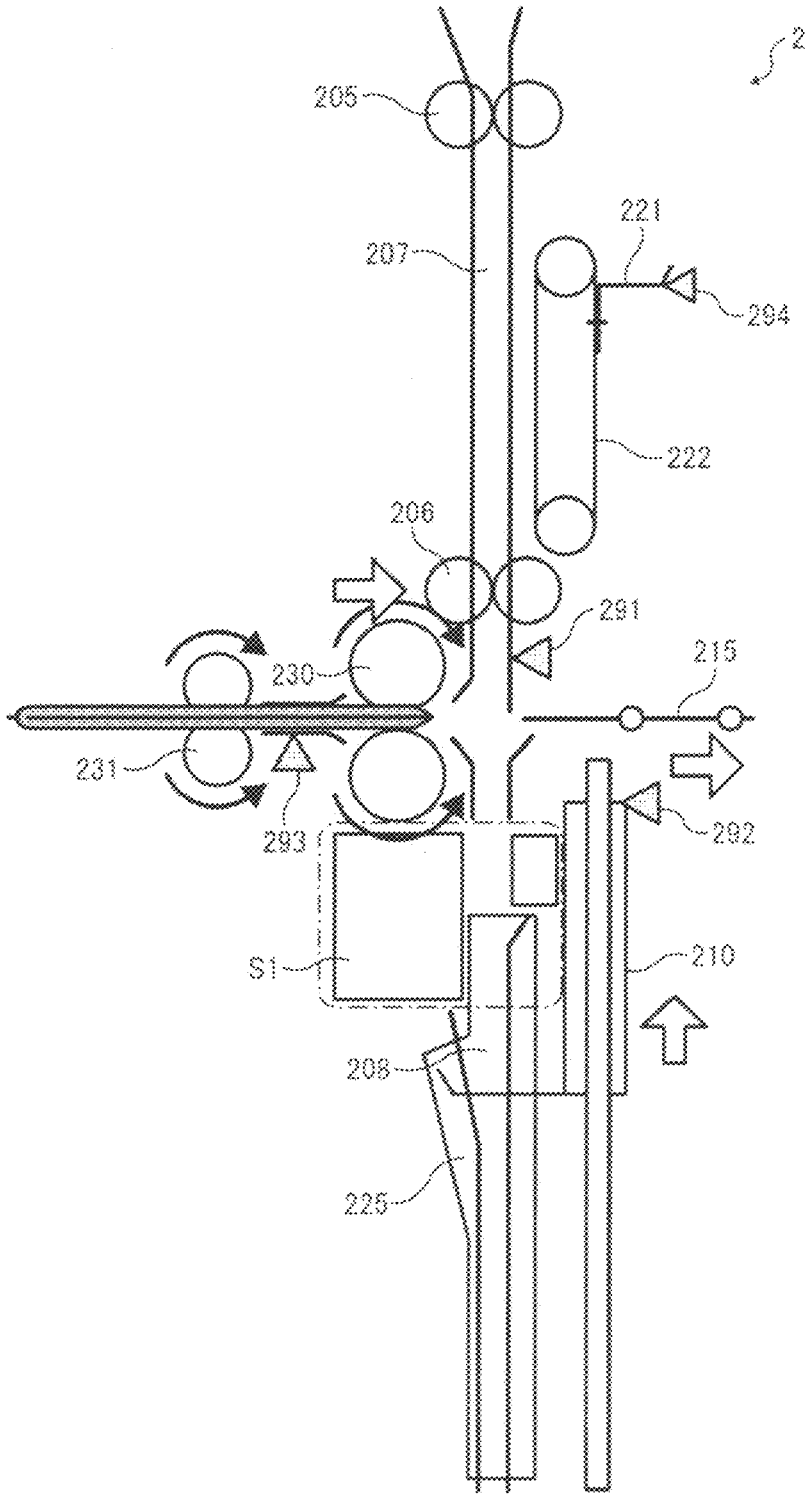
FIG. 7 illustrates the post-processing apparatus from which the bundle of folded sheets is discharged.

FIG. 6 illustrates a state in which a folded leading edge of the booklet SB is squeezed in the nip between the folding rollers 230.

After the bundle of sheets SB is set at the position shown in FIG. 5, the folding plate 215 approaches the nip between the pair of folding rollers 230 as shown in FIG. 6 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and sandwiched between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB.

After folded in two as shown in FIG. 6, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 can wait again at the position shown in FIG. 3. The above-described control is performed also by the CPU 111 of the control circuit 110.

Figure 8:
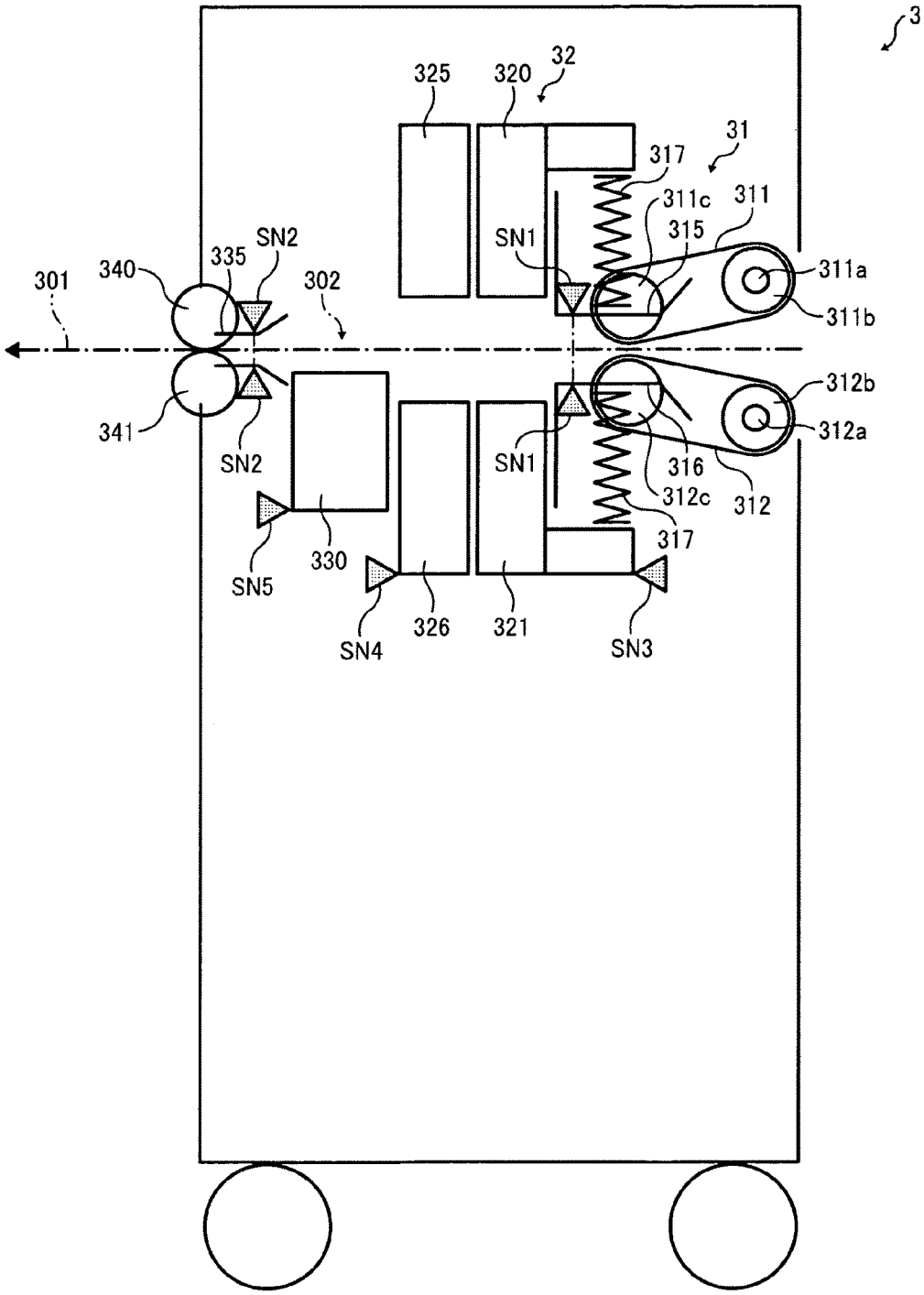
FIG. 8 is a front view illustrating a configuration of the spine formation devices shown in FIG. 1.

FIG. 8 is a front view illustrating a configuration of the spine formation device 3 shown in FIG. 1.

Referring to FIG. 8, the spine formation device 3 includes the conveyance unit 31 serving as the sheet conveyer, an auxiliary sandwiching unit 32 serving as the first sandwiching unit, the vertically-arranged sandwiching plates 325 and 326 serving as the second sandwiching unit, the contact plate 330 serving as the contact member, and a discharge unit 33.

The conveyance unit 31 includes the vertically-arranged transport belts 311 and 312, the auxiliary sandwiching unit 32 includes the vertically-arranged guide plates 315 and 316 and the vertically-arranged auxiliary sandwiching plates 320 and 321, and the discharge unit 33 includes a discharge guide plate 335 and the pair of discharge rollers 340 and 341 in FIG. 8. It is to be note that the lengths of the respective components are greater than the width of the bundle of sheets SB in a direction perpendicular to the surface of paper on which FIG. 8 is drawn.

The upper transport belt 311 and the lower transport belt 312 are respectively stretched around driving pulleys 311*b* and 312*b* supported by swing shafts 311*a* and 312*a* and driven pulleys 311*c* and 312*c* disposed downstream from the driving pulleys 311*b* and 312*b*. A driving motor, not shown, drives the transport belts 311 and 312. The transport belts 311 and 312 are disposed on both sides of (in FIG. 8, above and beneath) a transport centerline 301 of a transport path 302, aligned the line extended from the line connecting the folding plate 215, the nip between the folding rollers 230, and the nip between the discharge rollers 231. The swing shafts 311*a* and 312*a* respectively support the transport belts 311 and 312 swingably so that the gap between the driven pulleys 311*c* and 312*c* is adjusted corresponding to the thickness of the bundle of sheets. The upper guide plate 315 and the lower guide plate 316 are respectively attached to the upper auxiliary sandwiching plate 320 and the lower auxiliary sandwiching plate 321 with pressure springs 317.

It is to be noted that, in FIG. 8, reference characters SN1 through SN5 respectively represent a sheet detector, a discharge detector, an auxiliary sandwiching plate HP detector, a sandwiching plate HP detector, and a contact plate HP detector. Further, in the configuration shown in FIG. 8, the transport centerline 301 means a center of the transport path 302 in the vertical direction.

Figure 9A:
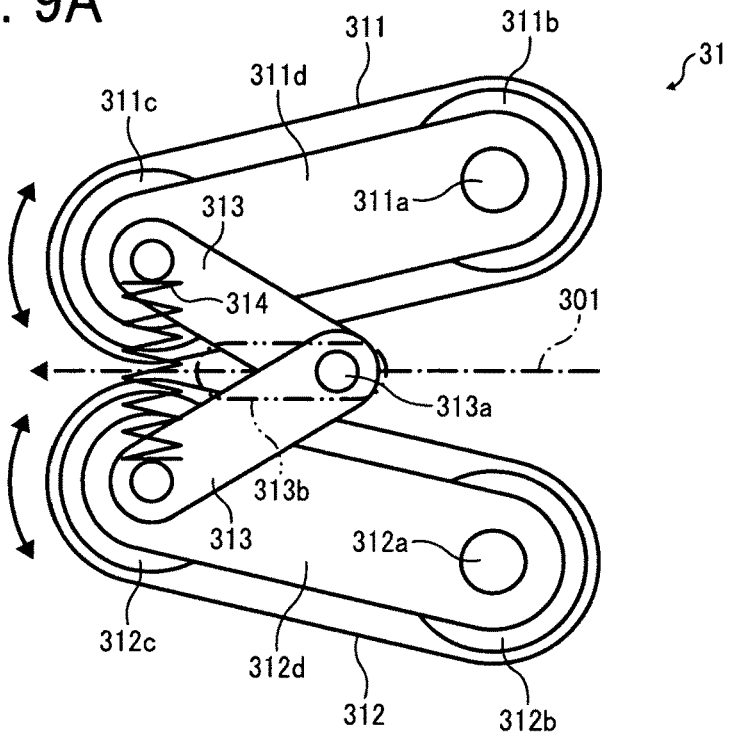
FIG. 9A illustrates an initial state of a transport unit of the spine formation device shown in FIG. 8 to transport a bundle of folded sheets.
Figure 9B:
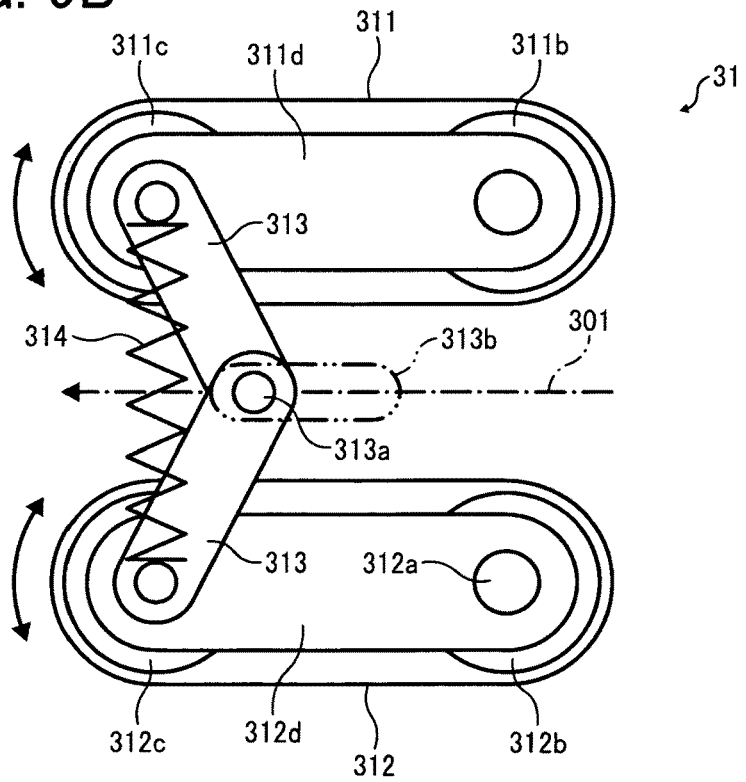
FIG. 9B illustrates a state of the transport unit shown in FIG. 9A in which the bundle of folded sheets is transported.

The conveyance unit 31 to transport the bundle of sheets SB using the vertically-arranged transport belts 311 and 312 is described in further detail below with reference to FIGS. 9A and 9B. FIGS. 9A and 9B illustrate an initial state of the spine formation device 3 and a state in which the bundle of sheets SB is transported therein, respectively.

As shown in FIGS. 9A and 9B, the driving pulleys 311*b* and 312*b* are connected to the driven pulleys 311*c* and 312*c* with support plates 311*d* and 312*d*, respectively, and the transport belts 311 and 312 are respectively stretched around the driving pulleys 311*b* and 312*b* and the driven pulleys 311*c* and 312*c*. With this configuration, the transport belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b*, thus changing the distance between the driven pulleys 311*c* and 312*c* corresponding to the thickness of the booklet SB while maintaining a predetermined or given pressure in a nip where the transport belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SB is relatively thick, the distance between the driven pulleys 311*c* and 312*c* (hereinafter "transport gap") can be increased to receive the booklet SB, thus reducing the pressure applied to the folded portion (folded leading-edge portion) of the booklet SB by the transport belts 311 and 312 on the side of the driven pulleys 311*c* and 312*c*. It is to be noted that, when power supply to the driving motor is stopped after the folded portion of the booklet SB is sandwiched between the transport belts 311 and 312, the driven pulleys 311*c* and 312*c* can transport the booklet SB sandwiched therebetween with only the elastic bias force of the pressure spring 314.

Figure 10A:
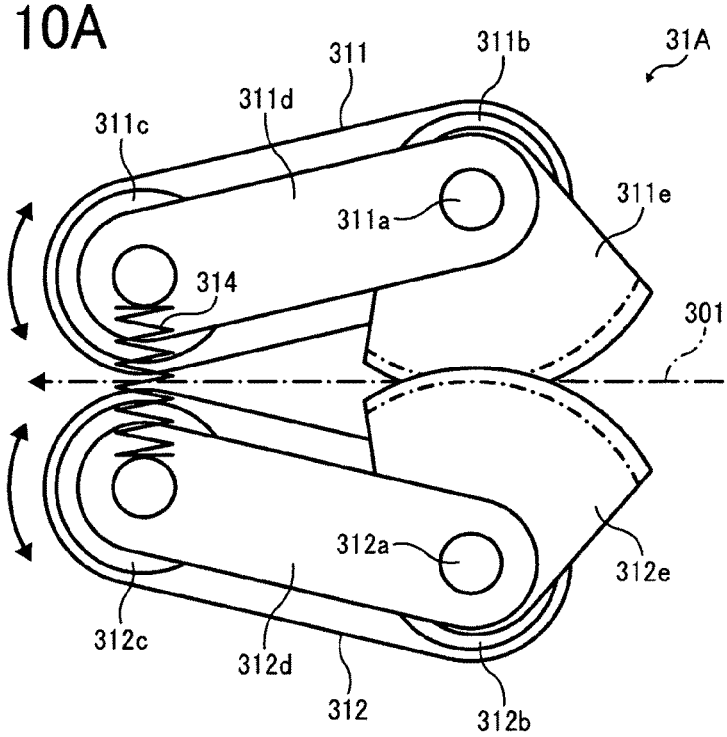
FIGS. 10A and 10B are diagrams of another configuration of the transport unit illustrating an initial state and a state in which the bundle of folded sheets is transported, respectively.
Figure 10B:
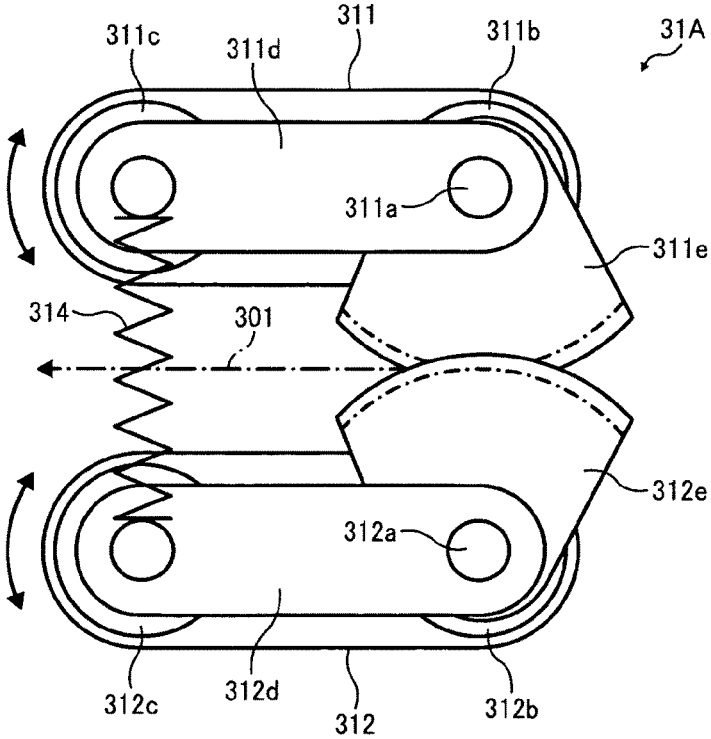

A conveyance unit 31A as another configuration of the conveyance unit is described below with reference to FIGS. 10A and 10B. FIGS. 10A and 10B illustrate an initial state of the conveyance unit 31A and a state in which the bundle of sheets SB is transported therein, respectively.

In the conveyance unit 31A, the swing shafts 311*a* and 312*a* engage sector gears 311*e* and 312*e* instead of using the link 313, respectively, and the sector gears 311*e* and 312*e* engaging each other cause the driven pulleys 311*c* and 312*c* to move vertically away from the transport centerline 301 symmetrically. Also in this configuration, the size of the transport gap to receive the booklet SB can be adjusted by driving one of the sector gears 311*e* and 312*e* with a driving motor including a decelerator similarly to the configuration shown in FIGS. 9A and 9B.

As shown in FIG. 8, the guide plates 315 and 316 are disposed adjacent to the driven pulleys 311*c* and 312*c*, respectively, and arranged symmetrically on both sides of the transport centerline 301, that is, above and beneath the transport centerline 301 in FIG. 8. The guide plates 315 and 316 respectively include flat surfaces in parallel to the transport path 302, extending from the transport nip to a position adjacent to the auxiliary sandwiching plates 320 and 321, and the flat surfaces serve as transport surfaces. The upper guide plate 315 and the lower guide plate 316 are attached to the upper auxiliary sandwiching plate 320 and the lower auxiliary sandwiching plate 321 with pressure springs 317, respectively. The upper guide plate 315 and the lower guide plate 316 are biased to the transport centerline 301 elastically by the respective pressure springs 317 and can move vertically. Further, the auxiliary sandwiching plates 320 and 321 are held by a housing of the spine formation device 3 movably in the vertical direction in FIG. 8. It is to be noted that, alternatively, the guide plates 315 and 316 may be omitted, and the booklet SB may be guided by only surfaces of the auxiliary sandwiching plates 320 and 321 facing the booklet SB, parallel to the transport path 302.

The vertically-arranged auxiliary sandwiching plates 320 and 321 of the auxiliary sandwiching unit 32 approach and move away from each other symmetrically relative to the transport centerline 301 similarly to the transport belts 311 and 312. A driving mechanism, not shown, provided in the auxiliary sandwiching unit 32 to cause this movement can use the link mechanism used in the conveyance unit 31 or the connection mechanism using the rack and the sector gear shown FIGS. 10A and 10B. A reference position used in detecting a displacement of the auxiliary sandwiching plates 320 and 321 can be set with the output from the auxiliary sandwiching plate HP detector SN3. Because the vertically-arranged auxiliary sandwiching plates 320 and 321 and the driving unit, not shown, are connected with a spring similar to the pressure spring 314 in the transport unit 31, or the like, when the booklet SB is sandwiched by the auxiliary sandwiching plates 320 and 321, damage to the driving mechanism caused by overload can be prevented. The surfaces of the auxiliary sandwiching plates 320 and 321 (e.g., pressure sandwiching surfaces) that sandwich the booklet SB are flat surfaces in parallel to the transport centerline 301.

The vertically-arranged sandwiching plates 325 and 326, serving as the sandwiching unit, approach and move away from each other symmetrically relative to the transport centerline 301 similarly to the transport belts 311 and 312. A driving mechanism to cause the sandwiching plates 325 and 326 this movement can use the link mechanism used in the transport unit 31 or the connection mechanism using the rack and the sector gear shown FIGS. 10A and 10B. A reference position used in detecting a displacement of the sandwiching plates 325 and 326 can be set with the output from the sandwiching plate HP detector SN4. Other than the description above, the sandwiching plates 325 and 326 have configurations similar the auxiliary sandwiching plates 320 and 321 and operate similarly thereto, and thus descriptions thereof are omitted. It is to be noted that a driving source such as a driving motor is requisite in the auxiliary sandwiching unit 32 and the sandwiching unit although it is not requisite in the transport unit 31, and the driving source enables the movement between a position to sandwich the booklet and a standby position away form the booklet. The surfaces of the auxiliary sandwiching plates 325 and 326 (e.g., pressure sandwiching surfaces) that sandwich the booklet are flat surfaces in parallel to the transport centerline 301 similarly to the auxiliary sandwiching plates 320 and 321.

The contact plate 330 is disposed downstream from the sandwiching plates 325 and 326. The contact plate 330 and a mechanism, not shown, to move the contact plate 330 vertically in FIG. 8 together form a contact unit. The contact plate 330 moves vertically in FIG. 8 to obstruct the transport path 302 and away from the transport path 302, and a reference position used in detecting a displacement of the contact plate 330 can be set with the output from the contact plate HP detector SN5. When the contact plate 330 is away from the transport path 302, a top surface of the contact plate 330 guides the booklet SB. Therefore, the top surface of the contact plate 330 is flat, in parallel to the sheet conveyance direction, that is, the transport centerline 301. For example, although not shown in the drawings, the mechanism to move the contact plate 330 can include rack-and-pinions provided on both sides of the contact plate 330, that is, a front side and a back side of the spine formation device 3, and a driving motor to drive the pinions. With this configuration, the contact plate 330 can be moved vertically and set at a predetermined position by driving the driving motor.

It is to be noted that, alternatively, screw driving may be used to move the guide plates 315 and 316, the auxiliary sandwiching plates 320 and 321, the sandwiching plates 325 and 326, and the contact plate 330.

Figure 18:
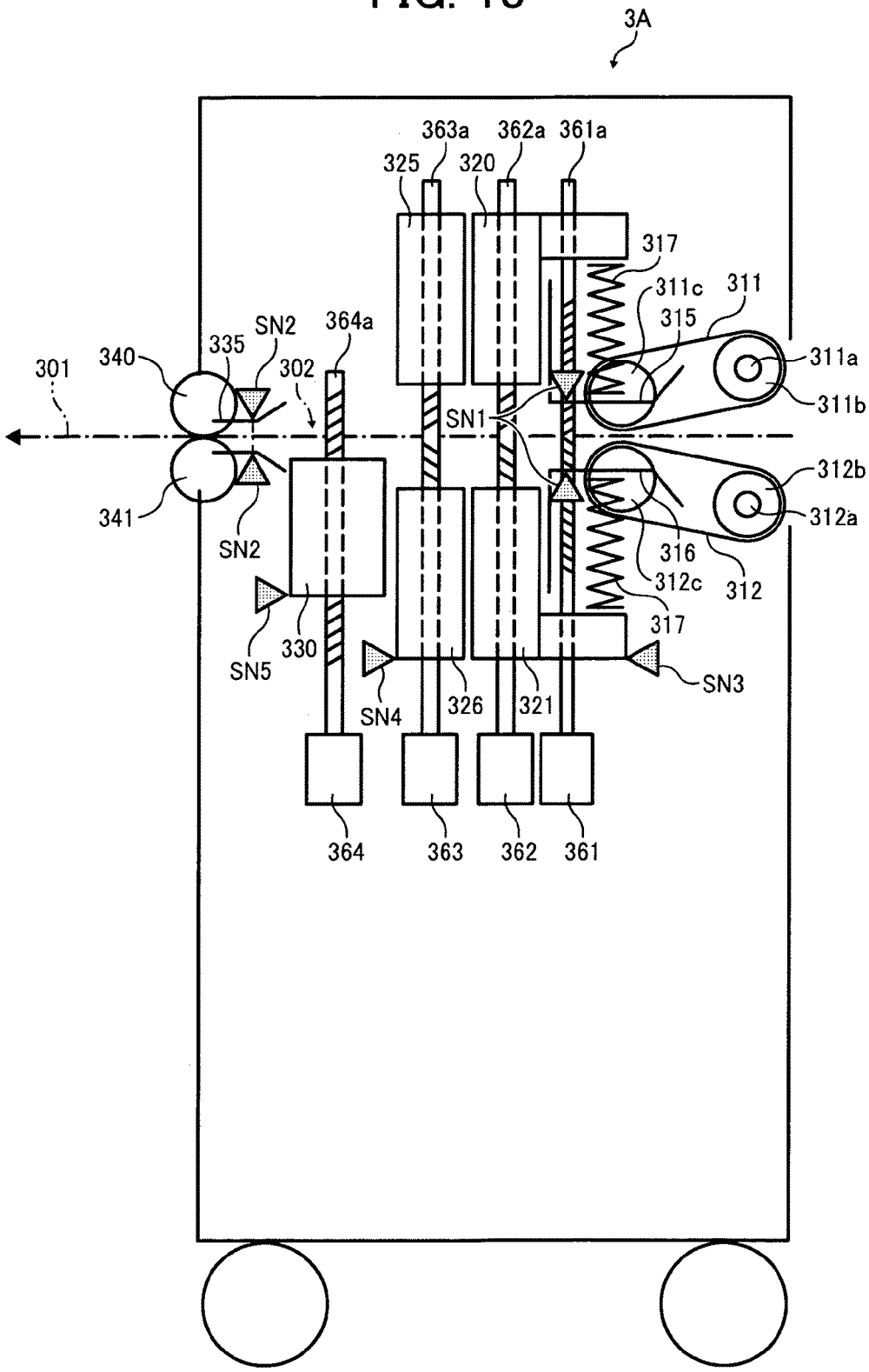
FIG. 18 illustrates a configuration of a spine formation device according to an illustrative embodiment that uses a screw driving to move a pair of guide plates, the pair of auxiliary sandwiching plates, the pair of sandwiching plates, and the contact plate.

FIG. 18 illustrates a configuration of a spine formation device 3A that includes driving motors 361, 362, 363, and 364 and screw shafts 361*a*, 362*a*, 363*a*, and 364*a* coaxially with driving shafts of the driving motors 361 through 364, respectively, as the driving mechanism to drive the respective portions. Other than the driving mechanisms, the spine formation device 3A has a similar configuration to that of the spine formation device 3 shown in FIG. 8, and thus description thereof is omitted.

The motors 361 through 364 respectively include decelerators. The screw shafts 361*a*, 362*a*, and 363*a* to drive the guide plates 315 and 316, the auxiliary sandwiching plates 320 and 321, and the sandwiching plates 325 and 326 each have a screw thread winding in opposite directions from a center portion (in FIG. 18, the transport centerline 301). In FIG. 18, the upper auxiliary sandwiching plate 320 and the lower auxiliary sandwiching plate 321 are respectively attached to the upper portions and the lower portions of the screw shafts 361*a* and 362*a* having the screw threads winding in the opposite directions. Similarly, the upper sandwiching plate 325 and the lower sandwiching plate 326 are respectively attached to the upper portion and the lower portion of the screw shaft 363*a* having the screw thread winding in the opposite directions.

With this configuration, the pair of the auxiliary sandwiching plates 320 and 321 and the pair of sandwiching plates 325 and 326 can move symmetrically in the direction to approach and the direction away from each other depending on the rotation direction of the driving motors 361, 362, and 363. The axis of symmetry thereof is the transport centerline 301. The driving motor 364 and the screw shaft 364*a* coaxially therewith move the contact plate 330 vertically in FIG. 18.

The screw shafts 361*a*, 362*a*, 363*a*, and 364*a* are disposed on the back side of the spine formation device 3A, outside the sheet area in which the booklet passes through, and guide rods, not shown, that respectively guide the pair of guide plates 315 and 316, the pair of the auxiliary sandwiching plates 320 and 321, the pair of sandwiching plates 325 and 326, and the contact plate 330 slidingly are provided on the front side outside the sheet area. With this configuration, the pair of guide plates 315 and 316, the pair of the auxiliary sandwiching plates 320 and 321, the pair of sandwiching plates 325 and 326, and the contact plate 330 can move vertically in parallel to the respective screw shafts 361*a*, 362*a*, 363*a*, and 364*a* engaged therewith as well as the respective guide rods.

Referring to FIG. 8, the discharge unit 33 is disposed downstream from the contact plate 330. The discharge unit 33 includes the pair of discharge guide plates 335 and the pair of discharge rollers 340 and 341 to discharge the booklet SB outside the spine formation device 3 after spine formation. The sheet detector SN1 detects the folded portion of the booklet SB.

The position of the booklet SB during spine formation is set by adjusting a sum of the distance by which the booklet SB is transported (hereinafter "first distance") from the position detected by the sheet detector SN1 to the position (contact position) where the folded portion of the booklet SB contacts the downstream surface (contact surface) of the contact plate 330 and a predetermined distance from the contact position. More specifically, the distance by which the booklet SB is transported from the position detected by the sheet detector SN1 to the position at which the booklet SB is kept during spine formation is the sum of the first distance by which the booklet SB is moved from the position detected by the sheet detector SN1 to the contact position between the folded portion and the contact plate 330 and the predetermined distance from the contact position. The predetermined distance from the contact position can be determined in accordance with the amount of bulging, that is, the portion expanded in the thickness direction, necessary to shape the folded portion into the spine. This transport distance can be adjusted through pulse control, control using an encoder, or the like. It is to be noted that the sheet detector SN1 is disposed between the transport belts 311 and 312 and the contact plate 330 in the sheet conveyance direction. Additionally, the discharge detector SN2 is provided upstream from the lower discharge roller 341, adjacent thereto, and detects the passage of the booklet SB in the transport path 302.

Figure 20:
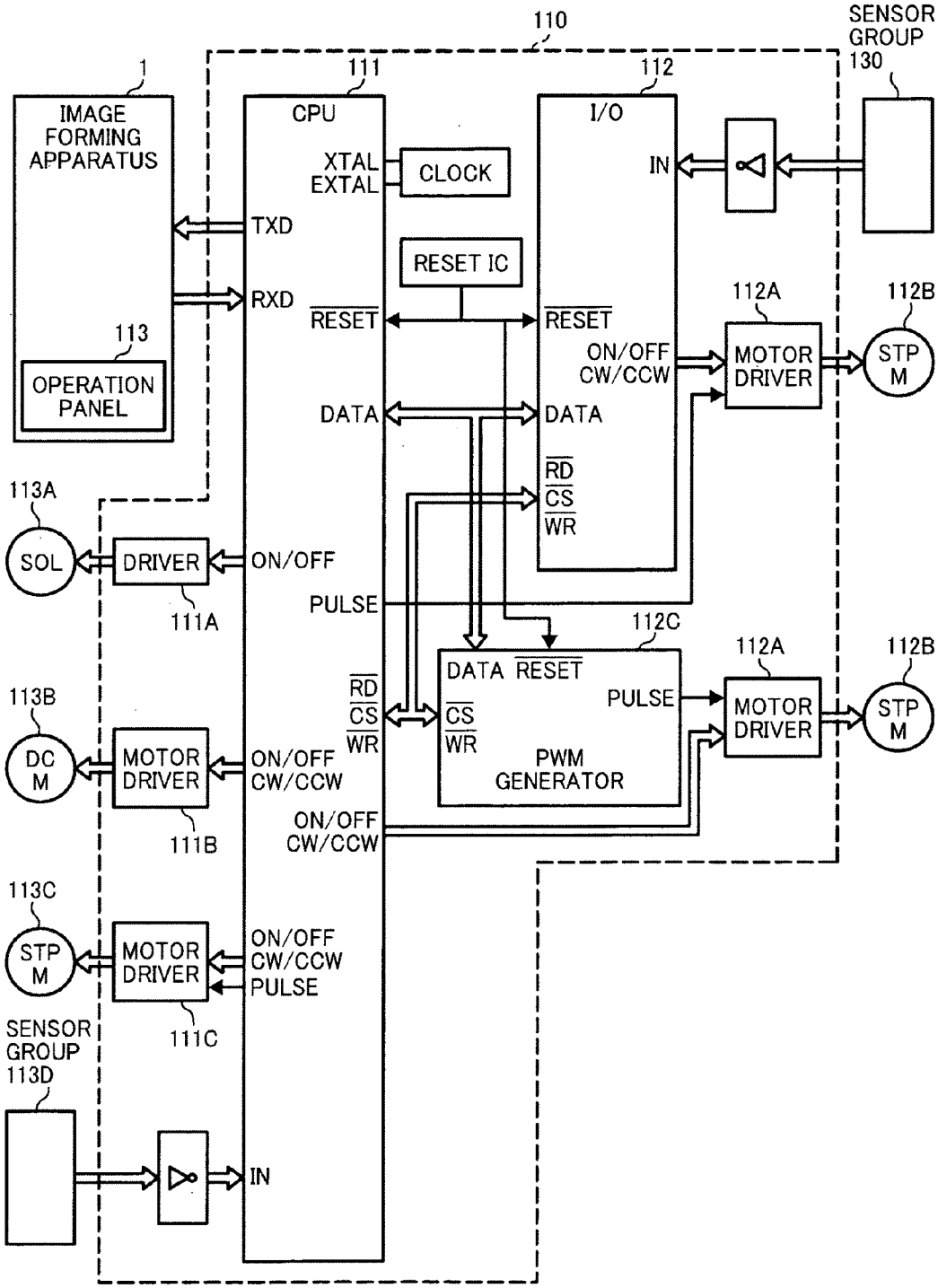
FIG. 20 is a block diagram illustrating circuitry of a control circuit of the spine formation device.

It is to be noted that the respective portions of the spine formation device 3 can be controlled by a CPU of a control circuit of the spine formation device 3 that is similar to the control circuit 110, shown in FIG. 20, of the post-processing apparatus 2. Further, the control circuit 110 of the post-processing apparatus 2 and the control circuit of the spine formation device 3 are connected serially to the control circuit of the image forming apparatus 1. The data relating to the bundle of sheets from the image forming apparatus 1 is transmitted to the post-processing apparatus 2 and further to the spine formation device 3, and the CPUs of the post-processing apparatus 2 and the spine formation device 3 perform control required for their operations and report the completion of the operations therein to the control circuit of the image forming apparatus 1, respectively.

Next, operations performed by the spine formation device 3 to flatten the folded portion, that is, the spine, of the booklet SB are described in further detail below referring to FIGS. 11 through 17. It is to be noted that reference character SB1 represents the folded portion (folded leading-edge portion) of the booklet SB.

In the spine formation according to the present embodiment, the spine of the booklet SB as well as the front cover side and the bock cover side thereof are flattened.

Figure 11:
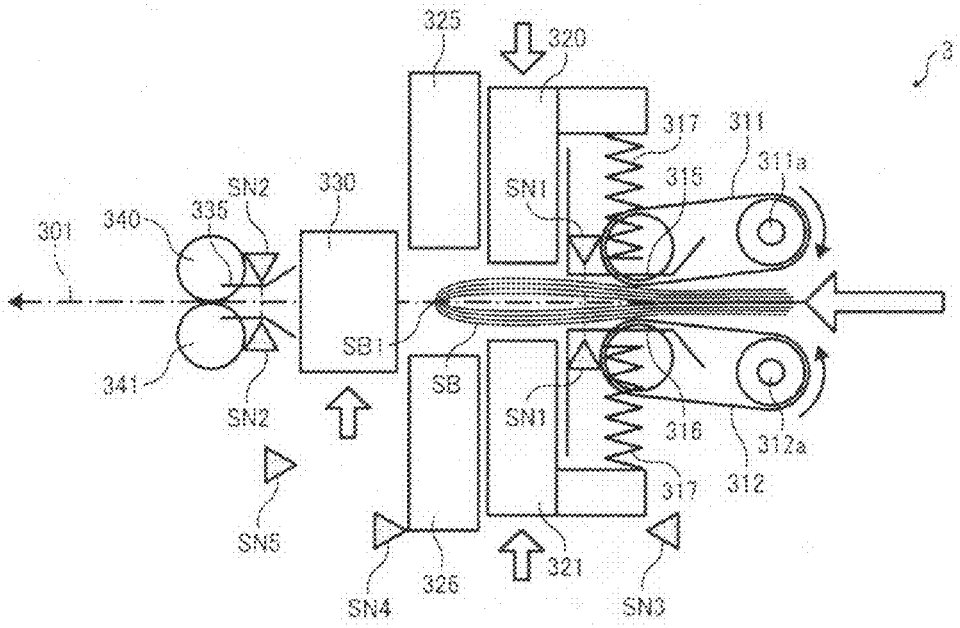
FIG. 11 illustrates a state of the spine formation device in which the bundle of folded sheets is transported therein.

FIG. 11 illustrates a state before the booklet SB enters the spine formation device 3.

Referring to FIG. 11, according to a detection signal of the booklet SB generated by an entrance sensor, not shown, of the spine formation device 3 or the folded portion detector 293 (shown in FIG. 7) of the post-processing apparatus 2, the respective portions of the spine formation device 3 perform preparatory operations to receive the booklet SB. In the preparatory operations, the pair of transport belts 311 and 312 starts rotating. Additionally, the upper auxiliary sandwiching plate 320 and the lower auxiliary sandwiching plate 321 move to the respective home positions detected by the auxiliary sandwiching plate HP detector SN3, move toward the transport centerline 301 until the distance (hereinafter "transport gap") therebetween becomes a predetermined distance, and then stop at those positions. Similarly, the upper sandwiching plate 325 and the lower sandwiching plate 326 move to the respective home positions detected by the sandwiching plate HP detector SN4, move toward the transport centerline 301 until the distance (transport gap) therebetween becomes a predetermined distance, and then stop at those positions.

It is to be noted that, because the pair of auxiliary sandwiching plates 320 and 321 as well as the pair of sandwiching plates 325 and 326 are disposed and move symmetrically relative to the transport centerline 301, when only one of the counterparts in the pair is detected at the home position, it is known that the other is at the home position as well. Therefore, the auxiliary sandwiching plate HP detector SN3 and the sandwiching plate HP detector SN4 are disposed on only one side of the transport centerline 301.

The contact plate 330 moves to the home position detected by the contact plate HP detector SN5, moves toward the transport centerline 301 a predetermined distance, and then stops at a position obstructing the transport path 302.

Figure 12:
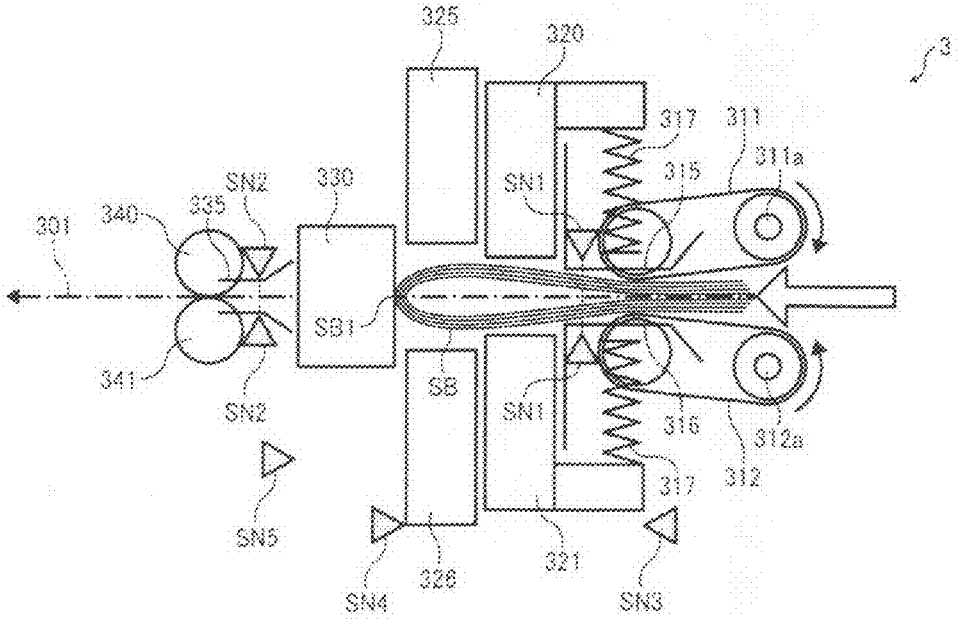
FIG. 12 illustrates a process of spine formation performed by the spine formation device in which the leading edge of the bundle of folded sheets is in contact with a contact plate.

In this state, when the booklet SB is forwarded by the discharge rollers 231 of the post-processing apparatus 2 to the spine formation device 3, the rotating transport belts 311 and 312 transport the booklet SB inside the device as shown in FIG. 11. The sheet detector SN1 detects the folded portion SB1 of the booklet SB, and then the booklet SB is transported the predetermined transport distance that is the sum of the first distance until the folded portion SB1 contacts the contact plate 330 and the predetermined distance from the contact position, necessary to form the spine by expanding the folded portion SB1 in the thickness direction, after which the booklet SB is kept at that position as shown in FIG. 12. The predetermined distance from the contact position can be determined according to the data relating to the booklet SB such as the thickness, the sheet size, the number of sheets, and the sheet type of the booklet SB.

Figure 13:
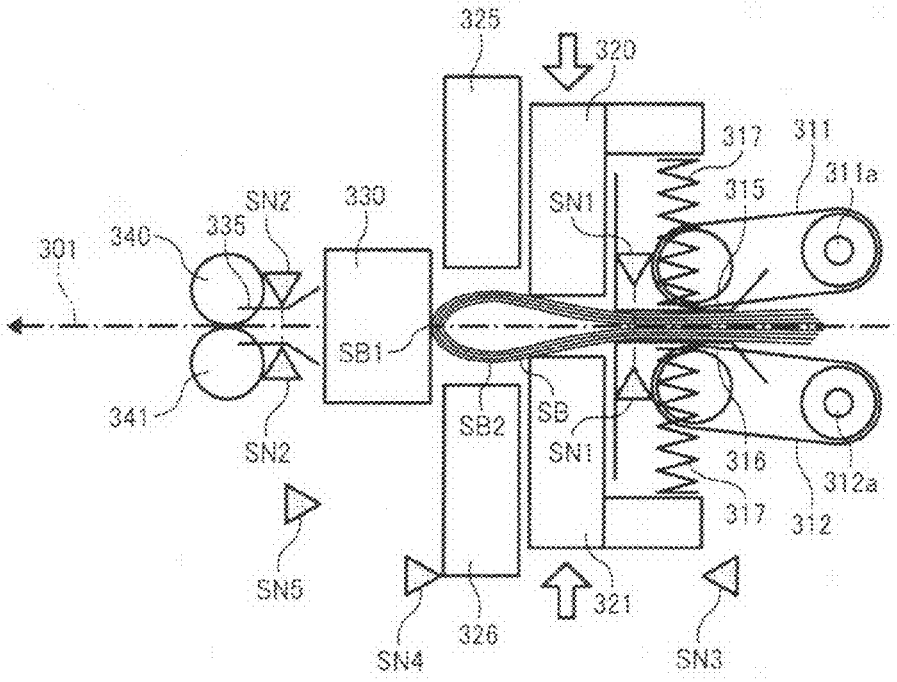
FIG. 13 illustrates a process of spine formation performed by the spine formation device in which a pair of auxiliary sandwiching plates approaches the bundle of folded sheets to sandwich it therein.
Figure 14:
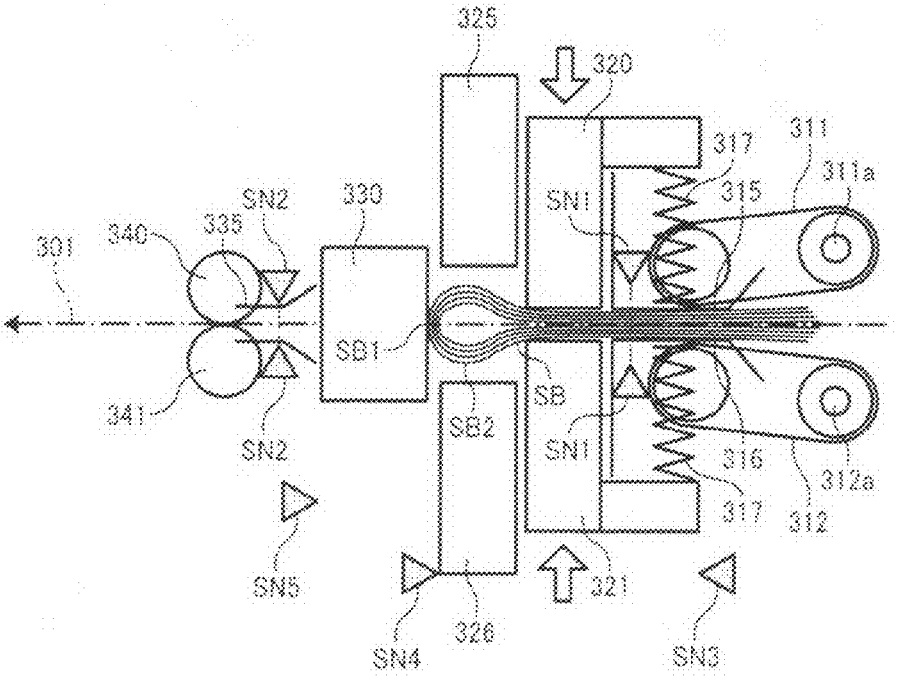
FIG. 14 illustrates a process of spine formation performed by the spine formation device in which the pair of auxiliary sandwiching plates squeezes the bundle of folded sheets.

When the booklet SB is stopped in the state shown in FIG. 12, referring to FIG. 13, the auxiliary sandwiching plates 320 and 321 start approaching the transport centerline 301, and the pair of guide plates 315 and 316 presses against the booklet SB sandwiched therein with the elastic force of the pressure springs 317 initially. In this state, a bulging portion SB2 is present upstream from the folded leading-edge portion SB1. After the pair of guide plates 315 and 316 applies a predetermined pressure to the booklet SB, the auxiliary sandwiching plates 320 and 321 further approach the transport centerline 301 to squeeze the booklet SB in the portion downstream form the portion sandwiched by the guide plates 315 and 316 and then stop moving when the pressure to the booklet SB reaches a predetermine or given pressure. Thus, the booklet SB is held with the predetermined pressure as shown in FIG. 14. With the folded leading-edge portion SB1 of the booklet SB pressed against the contact plate 330, the bulging portion SB2 upstream from the folded leading-edge portion SB1 is larger than that shown in FIG. 13.

Figure 15:
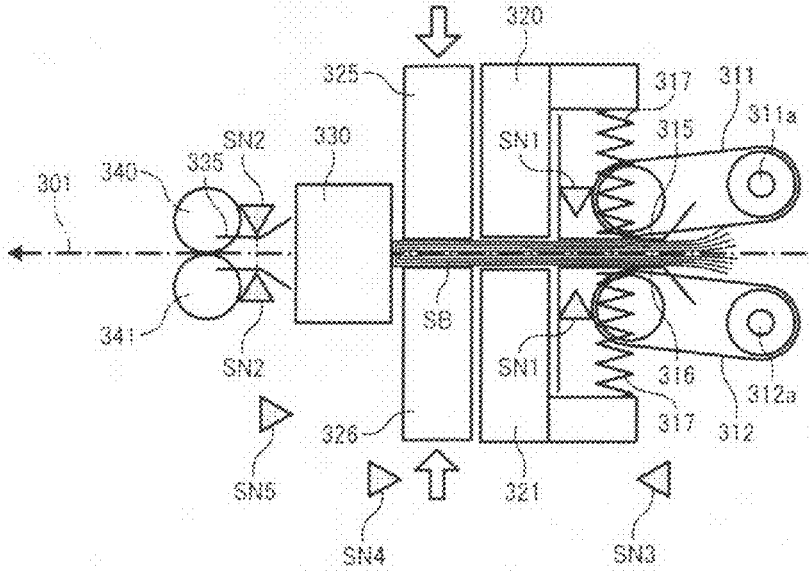
FIG. 15 illustrates a process of spine formation performed by the spine formation device in which a pair of sandwiching plates squeezes the bundle of folded sheets.

After the auxiliary sandwiching plates 320 and 321 squeeze the booklet SB as shown in FIG. 14, the sandwiching plates 325 and 326 start approaching the transport centerline 301 as shown in FIG. 15. With this movement, the bulging portion SB2 is localized to the side of the folded leading-edge portion SB1, pressed gradually, and then deforms following the shape of the space defined by the pair of sandwiching plates 325 and 326 and the contact plate 330. After this compressing operation is completed, the folded portion SB1 of the booklet SB is flat following the surface of the contact plate 330, and thus the flat spine is formed on the booklet SB. In addition, referring to FIG. 17, leading end portions SB3 and SB4 on the front side (front cover) and the back side (back cover) are flattened as well. Thus, booklets having square spines can be produced.

Figure 16:
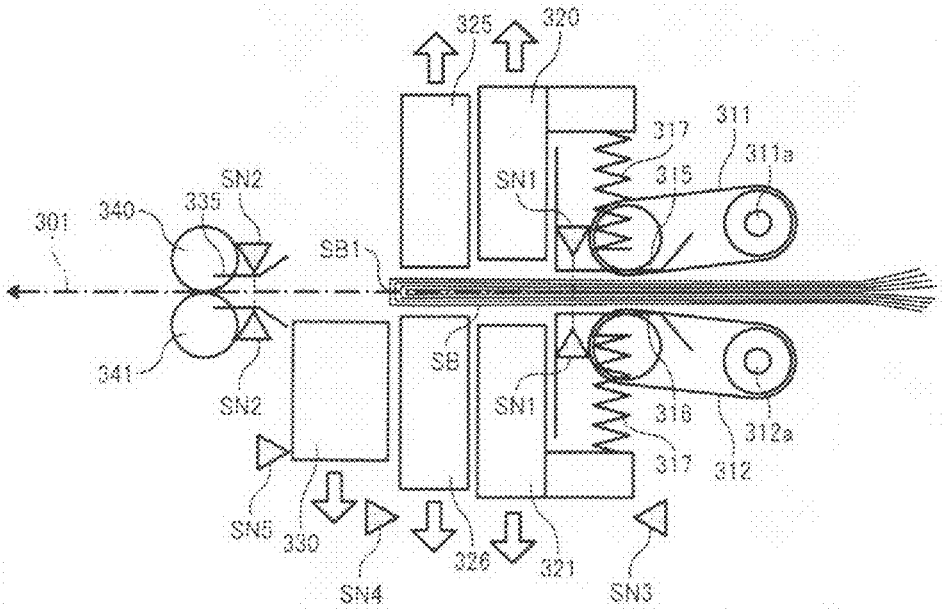
FIG. 16 illustrates completion of spine formation performed by the spine formation device in which the pair of auxiliary sandwiching plates and the pair of sandwiching plates are disengaged from the bundle of folded sheets.

Subsequently, as shown in FIG. 16, the auxiliary sandwiching plates 320 and 321 and the sandwiching plates 325 and 326 move away from the booklet SB to predetermined or given positions (standby positions), respectively. The contact plate 330 moves toward the home position and stops at a position where the top surface thereof guides the booklet SB.

Figure 17:
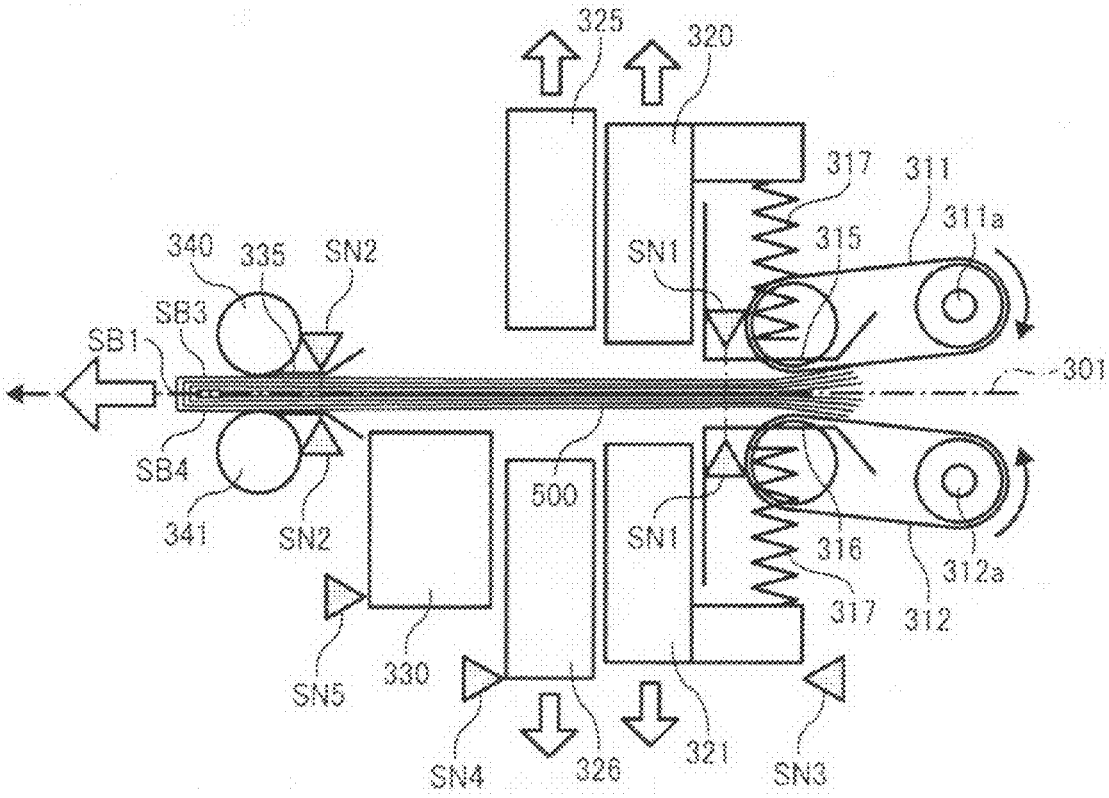
FIG. 17 illustrates a state in which the bundle of folded sheets is discharged from the spine formation device after spine formation.

After the auxiliary sandwiching plates 320 and 321, the sandwiching plates 325 and 326, and the contact plate 330 reach the respective standby positions, as shown in FIG. 17, the transport belts 311 and 312 and the pair of discharge rollers 340 and 341 start rotating, thereby discharging the booklet SB outside the spine formation device 3. Thus, a sequence of spine formation operations is completed. The transport belts 311 and 312 and the pair of discharge rollers 340 and 341 stop rotating after a predetermined time period has elapsed from the detection of the booklet SB by the discharge detector N2. Simultaneously, the respective movable portions return to their home positions. When subsequent booklets SB are sequentially sent form the post-processing apparatus 2, the time point at which the rotation of the transport belts 311 and 312 and the discharge rollers 340 and 341 is stopped is varied according to the transport state of the subsequent booklet SB. Additionally, it may be unnecessary to return the respective movable portions to their home positions each time, and the position to receive the booklet SB may be varied according to the transport state of and the data relating to the subsequent booklet SB. It is to be noted that the CPU of the above-described control circuit performs these adjustments.

Figure 19:
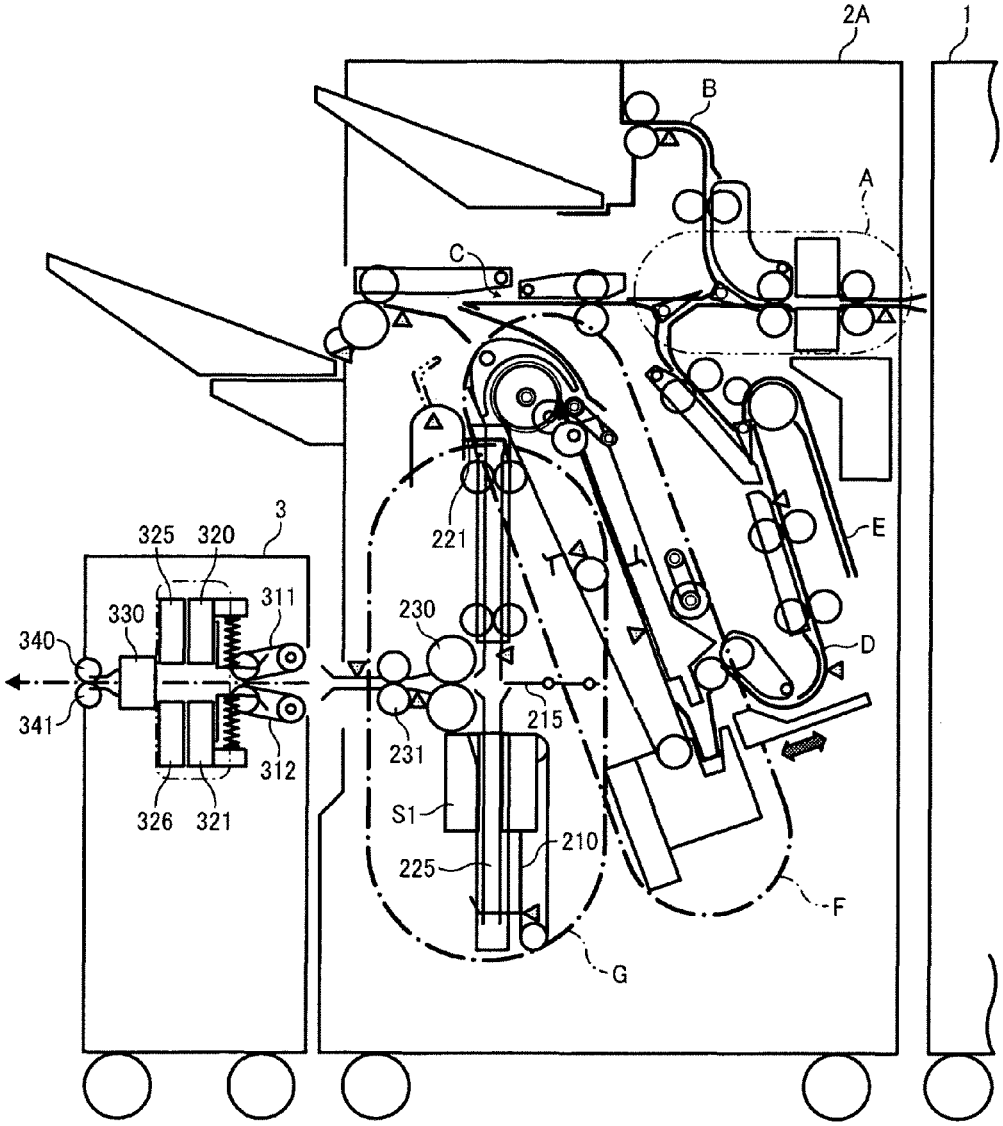
FIG. 19 illustrates a spine formation system including a post-processing apparatus according to an illustrative embodiment of the present invention and the spine formation device.

FIG. 19 illustrates a spine formation system according to another embodiment including a post-processing apparatus 2A that is a so-called finisher.

In the present embodiment, the device to perform saddle-stapling and center folding is incorporated in the post-processing apparatus 2A capable of other post processing such as sorting and punching of sheets, and the spine formation device 3 forms the spine of booklets SB saddle-stapled and folded in two in the post-processing apparatus 2A. The spine formation device 3 is similar or identical to that shown in FIG. 8 and the saddle-stapling and center folding mechanism of the post-processing apparatus 2A is similar or identical to that shown in FIG. 2, and thus the descriptions of the similar configurations are omitted.

The post-processing apparatus 2A includes an entrance path A along which sheets of recording media transported form an image forming apparatus 1 to the post-processing apparatus 2A are initially transported, a transport path B leading from the entrance path A to a proof tray (not shown), a shift tray path C leading from the entrance path A to a shift tray (not shown), a transport path D leading from the entrance path A to a edge-stapling tray F, a storage area E disposed along the transport path D, and a saddle processing tray G disposed downstream from the edge-stapling tray F in the sheet conveyance direction. The spine formation device 3 is connected to a downstream side of the post-processing apparatus 2A in the sheet conveyance direction. The edge-stapling tray F aligns multiple sheets and staples an edge portion of the aligned multiple sheets as required. The multiple sheets processed on the edge-stapling tray F are stored in the storage area E and then transported to the edge-stapling tray F at a time. The sheets transported along the entrance path A or discharged from the edge-stapling tray F are transported along the shift tray path C to the shift tray. The saddle processing tray G perform folding and/or saddle-stapling, that is, stapling along a centerline, of the multiple sheets aligned on the edge-stapling tray F. Then, the spine formation device 3 flattens a folded edge (spine) of a bundle of sheets (booklet). It is to be noted that the post-processing apparatus 2A has a known configuration and performs known operations, which are briefly described below.

The sheets transported to the post-processing apparatus 2A to be stapled along its centerline are stacked on the edge-stapling tray F sequentially. A jogger fence (not shown) aligns the sheets placed on the edge-stapling tray F in a width direction or transverse direction, which is perpendicular to the sheet conveyance direction. Further, a roller (not shown) pushes the sheets so that a trailing edge of the sheet contacts a back fence (not shown) disposed an upstream side in the sheet conveyance direction while a release belt (not shown) rotates in reverse so that a leading edge of the sheets is pressed by a back of a release pawl (not shown) disposed on a down stream side in the sheet conveyance direction, and thus a bundle of sheets are aligned in the sheet conveyance direction. After the sheets are aligned in the sheet conveyance direction as well as in the width direction, the release pawl and a pressure roller (not shown) turn the bundle of sheets a relatively large angle along a guide roller (not shown) to the saddle processing tray G.

Then, the bundle of sheets SB in the saddle processing tray G is further transported to a movable fence 210, and a pair of saddle stapling fences 225 aligns the sheets in the width direction. Further, the trailing edge of the bundle of sheets SB is pushed to an aligning pawl 221, and thus alignment in the sheet conveyance direction is performed. After the alignment, saddle stapler S1 staples the bundle of sheets SB along its centerline into a booklet SB as bookbinding. Then, the movable fence 210 pushes a center portion (folded position) of the booklet SB to a position facing a folding plate 215. The folding plate 215 moves horizontally in FIG. 19, which is perpendicular to the sheet conveyance direction, and a leading edge portion of the folding plate 215 pushes the folded position of the booklet SB between a pair of folding rollers 230, thereby folding the booklet SB in two. Then, a pair of discharge rollers 231 forwards the folded booklet SB to the spine formation device 3.

As the spine formation device 3 has a configuration identical or similar to that shown in FIGS. 8 through 10 and performs operations identical or similarly to those shown in FIGS. 11 through 17, the similar descriptions are omitted.

It is to be noted that the driving mechanisms of the conveyance unit 31, the auxiliary sandwiching unit 32, the sandwiching members, and the contact member in the embodiments shown in FIGS. 8 through 19 are not limited to the above-described mechanisms, and other known mechanisms can be used.

As described above with reference to FIGS. 11 through 17, in the embodiments of the present invention, the spine of booklets are formed as follows.

1) The pair of transport belts 311 and 312, the pair of guide plates 315 and 316, the pair of auxiliary sandwiching plates 320 and 321, the pair of sandwiching plates 325 and 326, and the contact plate 330 are arranged along the transport path 302 in that order from the upstream side in the sheet conveyance direction. The pair of transport belts 311 and 312 transports the booklet SB that is saddle-stapled and folded and presses the folded portion of the booklet SB against the contact plate 330 disposed extreme downstream among the above-described portions, causing the portion adjacent to the folded portion of the booklet SB to bulge inside the transport path 302.

2) With the booklet SB held in this state, the pair of guide plates 315 and 316, the pair of auxiliary sandwiching plates 320 and 321, and the pair of sandwiching plates 325 and 326 reduce the distance (transport gap) between the counterparts sequentially in that order, and thus the booklet SB is pressed. Consequently, the bulging portion SB2 is localized to the downstream side gradually.

3) Subsequently, the sandwiching plates 325 and 326 squeeze the booklet SB sandwiched therebetween with the folded leading-edge portion SB1 pressed against the contact plate 330.

4) Thus, the folded leading-edge portion SB1 of the booklet SB is flattened following the surface of the contact plate 330 on the side perpendicular to the front cover and the bock cover, and the leading end portions of the front cover and the back cover continuous with the spine are flattened as well. Thus, the portion around the spine can be square.

Thus, in the embodiments of the present invention, the bulging portion is formed by squeezing the booklet SB in the thickness direction and pressing the leading edge of the booklet SB against the contact plate 330 from the upstream side in the sheet conveyance direction according to the timing at which the booklet SB is transported, and then the spine is formed by sandwiching the booklet SB with the sandwiching plates 325 and 326 with a predetermined pressure.

Further, the spine of the booklet is shaped along the shape of the compartment defined by the contact member (contact plate 330) and the second sandwiching unit (sandwiching plates 325 and 326). At that time, because the front cover as well as the back cover of the booklet can be flattened with the surfaces of the second sandwiching unit pressing against the booklet, the bulging of the folded sheets can be reduced with a relatively simple mechanism.

Thus, the spine and the portions on the front side and the back side adjacent to the spine are pressed and flattened so that the front side and the back side are perpendicular or substantially perpendicular to the spine, forming a square spine portion. As a result, the spine of the booklet can be shaped better and more efficiently.

Further, driving control of the respective pairs of movable components can be simpler because the two counterparts of the respective pairs move symmetrically and the transport belts 311 and 312 are connected to the auxiliary sandwiching plates 320 and 321, for example.

Therefore, in the embodiments of the present invention, the mechanism can be simpler and relatively compact.

Further, the sheet conveyer (transport bents 311 and 312) transports the booklet downstream in the sheet conveyance direction by the predetermined distance from the contact position between the folded leading-edge of the booklet and the contact member, causing the booklet to bulge. This configuration can obviate the need to move the contact member in the reverse direction of the sheet conveyance direction, and accordingly, the processing time can be reduced. This configuration can also obviate a driving mechanism for moving the contact member in the reverse direction of the sheet conveyance direction, and accordingly the driving mechanism of the spine formation device can be simpler.

Additionally, the driving force to drive the sheet conveyer can be smaller and accordingly the power consumption is reduced because the bulging of the booklet is created by the driven pulleys 311*c* and 312*c* in a relatively longer portion between the contact plate 330 and the driven pulleys 311*c* and 312*c* positioned extreme downstream in the sheet conveyer. Accordingly, the cost as well as the power consumption can be reduced, attaining an environmentally-friendly device.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device comprising:

a contact member including a flat contact surface against which a folded portion of a bundle of folded sheets is pressed, the contact surface disposed perpendicular to a sheet conveyance direction in which the bundle of folded sheets is conveyed;

a sheet conveyer that conveys the bundle of folded sheets in the sheet conveyance direction with the folded portion of the bundle of folded sheets forming a front end portion of the bundle of folded sheets;

a first sandwiching unit disposed downstream from the sheet conveyer in the sheet conveyance direction;

a second sandwiching unit disposed downstream from the first sandwiching unit in the sheet conveyance direction; and a controller operatively connected to the sheet conveyer and to the first and second sandwiching units to stop the sheet conveyer after the bundle of folded sheets is transported a predetermined distance downstream in the sheet conveyance direction from a contact position between the contact member and the folded portion of the bundle of folded sheets and to cause the first and second sandwiching units to squeeze the bundle of folded sheets in a direction of thickness of the bundle of folded sheets with the folded portion pressed against the contact member, the first sandwiching unit localizing a bulging of the bundle of folded sheets created between the sheet conveyer and the contact member to a downstream side in the sheet conveyance direction, the second sandwiching unit forming a spine of the bundle of folded sheets by squeezing a bulging of the bundle of folded sheets created between the first sandwiching unit and the contact member, wherein the predetermined distance the bundle of folded sheets is transported forms the spine by expanding the folded portion in the thickness direction.

2. The spine formation device according to claim 1, wherein the first sandwiching unit comprises a first pair of movable planar sandwiching members that move in the direction of thickness of the bundle of folded sheets, and the second sandwiching unit comprises a second pair of movable planar sandwiching members that move in the direction of thickness of the bundle of folded sheets.

3. The spine formation device according to claim 2, further comprising a pair of planar sheet guides disposed upstream from the first pair of planar sandwiching members of the first sandwiching unit, wherein the bundle of folded sheets is guided between the first pair of planar sandwiching members by the pair of planar sheet guides.

4. The spine formation device according to claim 3, wherein each of the planar sheet guides includes a flat transport surface facing the bundle of folded sheets and extending in the sheet conveyance direction from the sheet conveyer to a position upstream from the first pair of planar sandwiching members.

5. The spine formation device according to claim 4, wherein the pair of planar sheet guides is connected to the first pair of movable planar sandwiching members, and the pair of planar sheet guides moves in conjunction with the first pair of movable planar sandwiching members.

6. The spine formation device according to claim 1, wherein the second sandwiching unit comprises a pair of planar sandwiching members each including a flat surface pressed against the bundle of folded sheets, disposed in parallel to the sheet conveyance direction, and the pair of planar sandwiching members moves in the direction of thickness of the bundle of folded sheets.

7. The spine formation device according to claim 1, wherein the sheet conveyer comprises a pair of transport members disposed on both sides of a vertical center of a sheet transport path through which the bundle of folded sheets is transported, and the pair of transport members presses against the bundle of folded sheets sandwiched in a nip formed between the transport members and applies from both sides a driving force to the bundle of folded sheets.

8. The spine formation device according to claim 7, wherein the sheet conveyer further comprises a support member to which each of the transport members is connected, and each of the transport members supported by the support member moves a similar distance from the nip formed between the pair of transport members.

9. The spine formation device according to claim 1, further comprising a sheet detector disposed between the sheet conveyer and the contact member in the sheet conveyance direction, wherein the sheet conveyer stops the bundle of folded sheets after the bundle of folded sheets is transported in the sheet conveyance direction a sum of a distance from a detection position at which the sheet detector detects the bundle to the contact position between the contact member and the folded portion of the bundle and the predetermined distance from the contact position, and the predetermined distance from the contact position is determined in accordance with an amount of bulging of the folded portion used to form the spine of the bundle of folded sheets.

10. The spine formation device according to claim 1, wherein the bundle of folded sheets is saddle-stapled and folded in two.

11. The spine formation device according to claim 1, incorporated in a post-processing apparatus.

12. A spine formation system comprising:

an image forming apparatus;

a post-processing apparatus to perform post processing of sheets transported from the image forming apparatus; and a spine formation device comprising:

a contact member including a flat contact surface against which a folded portion of a bundle of folded sheets is pressed, the contact surface disposed perpendicular to a sheet conveyance direction in which the bundle of folded sheets is conveyed;

a sheet conveyer that conveys the bundle of folded sheets in the sheet conveyance direction with the folded portion of the bundle of folded sheets forming a front end portion of the bundle of folded sheets;

a first sandwiching unit disposed downstream from the sheet conveyer in the sheet conveyance direction;

a second sandwiching unit disposed downstream from the first sandwiching unit in the sheet conveyance direction; and a controller operatively connected to the sheet conveyer and to the first and second sandwiching units to stop the sheet conveyer after the bundle of folded sheets is transported a predetermined distance downstream in the sheet conveyance direction from a contact position between the contact member and the folded portion of the bundle of folded sheets and to cause the first and second sandwiching units to squeeze the bundle of folded sheets in a direction of thickness of the bundle of folded sheets with the folded portion pressed against the contact member, the first sandwiching unit localizing a bulging of the bundle of folded sheets created between the sheet conveyer and the contact member to a downstream side in the sheet conveyance direction, the second sandwiching unit forming a spine of the bundle of folded sheets by squeezing a bulging of the bundle of folded sheets created between the first sandwiching unit and the contact member, wherein the predetermined distance the bundle of folded sheets is transported forms the spine by expanding the folded portion in the thickness direction.

13. A spine formation method used in a spine formation device including a sheet conveyer, a first sandwiching unit, a second sandwiching unit, and a contact member disposed in that order in a sheet conveyance direction in which the bundle of folded sheets is transported, the spine formation method comprising:

transporting a bundle of folded sheets with the folded portion of the bundle of folded sheets forming a front end portion of the bundle of folded sheets in the sheet conveyance direction;

causing the bundle of folded sheets to bulge by stopping the bundle of folded sheets after the bundle of folded sheets is transported a predetermined distance downstream in the sheet conveyance direction from a contact position between the contact member and the folded portion of the bundle of folded sheets;

localizing a bulging of the bundle of folded sheets to a downstream side in the sheet conveyance direction by squeezing the bundle of folded sheets in a direction of thickness of the bundle of folded sheets with the first sandwiching unit; and forming a spine of the bundle of folded sheets by squeezing a bulging of the bundle of folded sheets created between the first sandwiching unit and the contact member in the direction of thickness of the bundle of folded sheets with the second sandwiching unit while the folded portion is pressed against the contact member.

* * * * *